US010339800B2

(12) United States Patent
Shen

(10) Patent No.: US 10,339,800 B2
(45) Date of Patent: Jul. 2, 2019

(54) METHOD AND DEVICE FOR PROCESSING TRAFFIC ROAD INFORMATION

(71) Applicant: Hangzhou Hikvision Digital Technology Co., Ltd., Hangzhou (CN)

(72) Inventor: Yefeng Shen, Hangzhou (CN)

(73) Assignee: HANGZHOU HIKVISION DIGITAL TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 15/759,445

(22) PCT Filed: May 25, 2016

(86) PCT No.: PCT/CN2016/083298
§ 371 (c)(1),
(2) Date: Mar. 12, 2018

(87) PCT Pub. No.: WO2017/041524
PCT Pub. Date: Mar. 16, 2017

(65) Prior Publication Data

US 2018/0261082 A1 Sep. 13, 2018

(30) Foreign Application Priority Data

Sep. 11, 2015 (CN) ..... 2015 1 0578095

(51) Int. Cl.
*G08G 1/01* (2006.01)

(52) U.S. Cl.
CPC ..... *G08G 1/0133* (2013.01); *G08G 1/0116* (2013.01); *G08G 1/0141* (2013.01)

(58) Field of Classification Search
None
See application file for complete search history.

(56) References Cited

U.S. PATENT DOCUMENTS 6,317,686 B1 * 11/2001 Ran ..... G01C 21/3691 701/117
8,405,521 B2 * 3/2013 Fujiwara ..... G08G 1/0112 340/905

(Continued)

FOREIGN PATENT DOCUMENTS

CN 103606274 A 2/2014

OTHER PUBLICATIONS

English Translation of International Search Report for PCT/CN2016/083298 dated Aug. 30, 2016 (2 pages).

*Primary Examiner* — Richard M Camby
(74) *Attorney, Agent, or Firm* — Shumaker, Loop & Kendrick, LLP

(57) ABSTRACT

The present application discloses a method and an apparatus for processing traffic road information. The method includes: obtaining acquired traffic parameters of a first target road section and/or the reliability of the traffic parameters within a first preset period; selecting a first fuzzy rule matrix table from a pre-stored set of fuzzy rule matrix tables based on the number of the traffic parameters and/or the reliability of the traffic parameters of the first target road section; determining the membership degree of each type of traffic conditions contained in the first fuzzy rule matrix table by calling a membership function; comparing the membership degrees of all types of traffic conditions contained in the first fuzzy rule matrix table to determine the real-time traffic condition for the first target road section within the first preset period. The present application solves technical problems in solutions of computing traffic states of a road by using a fuzzy rule in the prior art that analysis results for traffic road information are inaccurate due to a single fuzzy rule.

20 Claims, 3 Drawing Sheets

(56) References Cited

U.S. PATENT DOCUMENTS

| | | | | |
|---|---|---|---|---|
| 9,286,793 | B2 * | 3/2016 | Pan | G08G 1/00 |
| 2014/0114885 | A1 * | 4/2014 | Han | G06N 3/0454<br>706/12 |

* cited by examiner

METHOD AND DEVICE FOR PROCESSING TRAFFIC ROAD INFORMATION

The present application claims the priority to a Chinese patent application No. 201510578095.X, filed with the State Intellectual Property Office of People's Republic of China Sep. 11, 2015 and entitled "Method and device of processing traffic road information", which is incorporated herein by reference in its entirety.

TECHNICAL FIELD

The present application relates to the field of road traffic, and in particular to a method and an apparatus for processing traffic road information.

BACKGROUND

With the rapid development in the national economy and the acceleration of urbanization, the number of motor vehicles in our country and the volume of road traffic have dramatically increased. The contradiction between increasing of traffic demand and urban road infrastructure has become the principal contradiction in urban traffic, resulting in more and more traffic congestion and traffic jams. Therefore, traffic road information, especially traffic congestion information, has become particularly important. The impact of congestion on road traffic can be minimized by identifying congested road sections.

Currently, the identifying of traffic information mainly involves detection of traffic parameters by microwave radar sensors and estimation of road traffic states by using fuzzy rules and a membership function. However, there are problems as follows in estimating the road traffic states using the above method: 1. Traffic parameters are from single data source, which are detected by using microwave radar sensors only, and errors in the acquired traffic parameters will result in deviation in analysis results for road traffic states. 2. On actual ground roads, traffic lights can cause errors in the analysis results for traffic states for road sections near the traffic lights. 3. The existing fuzzy rule matrix that is used to calculate the road traffic states is too simple and does not vary flexibly with actual situations, which will result in inaccurate analysis results for road traffic states.

So far, no effective solution has been proposed yet for the technical problems, that analysis results for traffic road information are inaccurate due to a single fuzzy rule, in solutions of computing traffic states for a road by using a fuzzy rule described above.

SUMMARY

Embodiments of the present application provide a method and an apparatus for processing traffic road information to at least solve the technical problems, that analysis results for traffic road information are inaccurate due to a single fuzzy rule, in solutions of computing traffic states for a road by using a fuzzy rule in the prior art.

According to an aspect of embodiments of the present application, a method for processing traffic road information is provided. The method includes: obtaining traffic parameters of a first target road section and/or the reliability of the traffic parameters within a first preset period acquired by traffic detection devices; selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table; determining a membership degree for each type of traffic conditions contained in the first fuzzy rule matrix table by calling a membership function; and comparing the membership degrees of all types of traffic conditions contained in the first fuzzy rule matrix table to determine a real-time traffic condition for the first target road section within the first preset period. Preferably, the traffic parameters at least include any one or more of the parameters: a vehicle time occupancy rate, flow saturation of vehicle flow, and a vehicle speed. Preferably, the fuzzy rule matrix tables include any one of the following types of matrix tables: a one-dimensional fuzzy rule matrix table, a two-dimensional fuzzy rule matrix table, and a three-dimensional fuzzy rule matrix table. Preferably, the traffic conditions at least include the following types: Unblocked, Slow and Congested.

Preferably, in the case that there are at least two traffic parameters of the first target road section, the reliability of the traffic parameters of the first target road section is a combination of the reliability of each of the parameters. Preferably, selecting a first fuzzy rule matrix table from a pre-stored set of fuzzy rule matrix tables based on the number of the traffic parameters of the first target road section and/or the reliability of the traffic parameters includes: obtaining a group of fuzzy rule matrix tables from the pre-stored set of fuzzy rule matrix tables based on the number of the traffic parameters of the first target road section; and selecting a fuzzy rule matrix table that matches with the reliability of the traffic parameters of the first target road section from the group of fuzzy rule matrix tables to obtain the first fuzzy rule matrix table. Preferably, the dimension of each fuzzy rule matrix table contained in the group of fuzzy rule matrix tables is the same as the number of the parameters.

The preset traffic condition of each of units in the fuzzy rule matrix selected based on the reliability of traffic parameters can be different, achieving the objective of improving the accuracy of traffic road information analysis results. The corresponding fuzzy rule matrix table is obtained based on the number of traffic parameters and/or the reliability of traffic parameters, achieving the purpose of selecting a fuzzy rule table according to actual traffic conditions flexibly and solving the problem that a fuzzy rule table is too rigid.

Preferably, before obtaining acquired traffic parameters of a first target road section and/or the reliability of the traffic parameters within a first preset period, the method further includes: acquiring traffic data of the first target road section by using a plurality of traffic detection devices within the first preset period; preprocessing the traffic data to obtain traffic parameters of the first target road section. Preferably, the plurality of traffic devices at least include a combination of any of the following devices: a magnetic frequency vehicle detector, a wave frequency vehicle detector, a video vehicle detector, a coil vehicle detector, a microwave vehicle detector, a geomagnetic vehicle detector and a SCATS vehicle detector. Preferably, the preprocessing includes at least one or more of the following processings: filtering of the traffic data, time-space conversion of the traffic data, and data conversion of the traffic data. Traffic parameters are acquired by a plurality of traffic detection devices, solving the problem of inaccurate analysis results for traffic road information caused by a single data source when processing traffic road information in the prior art. as there may be inconsistencies in such as the acquisition cycle, acquisition location, acquisition accuracy, and acquired traffic data of the plurality of traffic detection devices for acquiring traffic data, traffic data detected by the plurality of traffic detection devices can be preprocessed, before using and analyzing traffic information, to solve the problem that there are inconsistencies in such as the acquisition cycle, acquisition location, acquisition accuracy, and acquired traffic data of the plurality of traffic detection devices. The traffic parameters of the first target road section are obtained after filtering of traffic data, time-space conversion of traffic data and data conversion of traffic data, achieving the effect of improving the accuracy of traffic road information analysis.

Preferably, preprocessing the traffic data to obtain traffic parameters of the first target road section includes: filtering the traffic data of the first target road section acquired by each of the traffic detection devices respectively according to preset filter conditions to obtain the filtered traffic data acquired by each of the traffic detection devices; performing the time-space conversion and/or data conversion on the filtered traffic data acquired by each of the traffic detection devices to obtain the traffic parameters of the first target road section. Preferably, the filter conditions at least include one or more of the following conditions: device parameters of the traffic detection devices, vehicle speed limits for different traffic conditions, vehicle flow limits for different types of roads, the vehicle time occupancy rate, correlations between different types of traffic parameters. The preset filter conditions for different traffic data can be different, erroneous data acquired by the traffic detection devices during traffic data acquisition are filtered out by filtering the traffic data, and time-space conversion and/or data conversion is performed on the filtered traffic data, which improves the accuracy of traffic road information analysis results.

Preferably, the traffic data at least include one or more types of the following parameters: a vehicle time occupancy rate, flow saturation of vehicle flow, and a vehicle speed. Preferably, performing the data conversion on the filtered traffic data acquired by each of the traffic detection devices to obtain the traffic parameters of the first target road section includes: calculating the reliability of each type of parameters detected by each of the traffic detection devices within the first preset period based on detection accuracy of each of the traffic detection devices and the data amount of each type of the parameters actually acquired within the first preset period; and calculating weighted average of each type of the parameters actually acquired by using the reliability of each type of parameters as weighting factors to obtain the traffic parameters of the first target road section within the first preset period. Preferably, the reliability of the traffic parameters is obtained by averaging the reliability of a same type of parameters detected by each of the traffic detection devices.

Preferably, in the case that a traffic data release period includes a plurality of time periods, each of which has a same duration as the first preset period, after comparing the membership degrees of all types of traffic conditions contained in the first fuzzy rule matrix table to determine a real-time traffic condition for the first target road section within the first preset period, the method further includes: obtaining the reliability of real-time traffic conditions for the first target road section within each of the time periods of the traffic data release period; accumulating the reliability of traffic conditions of a same type within each of the time periods to obtain a accumulated reliability value for each type of traffic conditions; determining a traffic condition with the highest accumulated reliability value as the real-time traffic condition for the first target road section within the traffic data release period. It should be noted that it is possible for the analysis of traffic road information to avoid being influenced by the influence of the start/end of a red light and the start/end of a green light on the traffic by performing the above steps. Preferably, a weighting factor can be preset for each time period according to the correlation between each time period and traffic lights, and a smaller weighting factor can be preset when traffic lights change over the time period, which improves the accuracy of analysis results for road traffic conditions.

Preferably, obtaining the reliability of real-time traffic conditions for the first target road section within each of the time periods of the traffic data release period includes: calculating, for each of the time periods, a proportion of time in which the traffic on the first target road section is in a passing state; calculating the reliability of the real-time traffic conditions for the first target section within each of the time periods based on the proportion of time in which the traffic is in the passing state and the reliability of the acquired traffic parameters of the first target road section within each of the time periods.

Preferably, in the case that a second target road section includes a plurality of spatially discontinuous road sections including the first target road section, wherein after determining a traffic condition with the highest accumulated reliability value as the real-time traffic condition for the first target road section within the traffic data release period, the method further includes: reading a plurality of road section weighting factors corresponding to the plurality of road sections; calculating the product of the weighting factor for each of the plurality of road sections and the reliability of the real-time traffic condition for a corresponding road section within the traffic data release period; accumulating the products of the road sections with a same type of traffic conditions to obtain a accumulated value for each type of traffic conditions; and determining a traffic condition with the highest accumulated value as the real-time traffic condition for the second target road section within the traffic data release period.

Preferably, in the case that the traffic data release period includes a plurality of time periods, each of which has a same duration as the first preset period, after comparing the membership degrees of all types of traffic conditions contained in the first fuzzy rule matrix table to determine a real-time traffic condition for the first target road section within the first preset period, the method further includes: reading a priority for each type of traffic conditions; and determining a traffic condition with a high priority among the real-time traffic conditions for the first target road section within each of the time periods as the real-time traffic condition for the first target road section within the traffic data release period. The above steps solve the problem that there are errors in the traffic condition analysis results caused by the traffic signal lights when processing the traffic road information is solved.

Preferably, determining a membership degree for each type of traffic conditions contained in the first fuzzy rule matrix table by calling a membership function includes: determining the membership degrees for the traffic parameters in the fuzzy rule matrix table by calling the membership function; and determining the membership degree of each type of traffic conditions contained in the fuzzy rule matrix based on the membership degrees of the traffic parameters in the fuzzy rule matrix table.

According to another aspect of the embodiments of the present application, an apparatus for processing traffic road information is provided. The apparatus includes: a first obtaining unit, configured for obtaining traffic parameters of a first target road section and/or the reliability of the traffic parameters within a first preset period acquired by traffic detection devices; a matching unit, configured for selecting a first fuzzy rule matrix table from a pre-stored set of fuzzy rule matrix tables based on the number of the traffic parameters of the first target road section and/or the reliability of the traffic parameters; a determining unit, configured for determining a membership degree for each type of traffic conditions contained in the first fuzzy rule matrix table by calling a membership function; and a comparing unit, configured for comparing the membership degrees of all types of traffic conditions contained in the first fuzzy rule matrix table to determine a real-time traffic condition for the first target road section within the first preset period. Preferably, the traffic parameters at least include any one or more of the parameters: a vehicle time occupancy rate, flow saturation of vehicle flow, and a vehicle speed. Preferably, the fuzzy rule matrix tables include any one of the following types of matrix tables: a one-dimensional fuzzy rule matrix table, a two-dimensional fuzzy rule matrix table, and a three-dimensional fuzzy rule matrix table. Preferably, the traffic conditions at least include the following types: Unblocked, Slow and Congested.

Preferably, in the case that there are at least two traffic parameters of the first target road section, the reliability of the traffic parameters of the first target road section is a combination of the reliability of each of the parameters, the matching unit includes: an obtaining module, configured for obtaining a group of fuzzy rule matrix tables from the pre-stored set of fuzzy rule matrix tables based on the number of the traffic parameters of the first target road section; and a matching module, configured for selecting a fuzzy rule matrix table that matches with the reliability of the traffic parameters of the first target road section from the group of fuzzy rule matrix tables to obtain the first fuzzy rule matrix table. Preferably, the dimension of each fuzzy rule matrix table contained in the group of fuzzy rule matrix tables is the same as the number of the parameters.

The preset traffic condition of each of units in the fuzzy rule matrix selected based on the reliability of traffic parameters can be different, achieving the objective of improving the accuracy of traffic road information analysis results. The corresponding fuzzy rule matrix table is obtained based on the number of traffic parameters and/or the reliability of traffic parameters, achieving the purpose of selecting a fuzzy rule table according to actual traffic conditions flexibly and solving the problem that a fuzzy rule table is too rigid.

Preferably, the apparatus further includes: an acquiring unit, configured for acquiring traffic data of the first target road section by using a plurality of traffic detection devices within the first preset period; a processing unit, configured for preprocessing the traffic data to obtain traffic parameters of the first target road section. Preferably, the plurality of traffic devices at least include a combination of any of the following devices: a magnetic frequency vehicle detector, a wave frequency vehicle detector, a video vehicle detector, a coil vehicle detector, a microwave vehicle detector, a geomagnetic vehicle detector and a SCATS vehicle detector. Preferably, the preprocessing includes at least one or more of the following processings: filtering of the traffic data, time-space conversion of the traffic data, and data conversion of the traffic data. Traffic parameters are acquired by a plurality of traffic detection devices, solving the problem of inaccurate analysis results for traffic road information caused by a single data source when processing traffic road information in the prior art. as there may be inconsistencies in such as the acquisition cycle, acquisition location, acquisition accuracy, and acquired traffic data of the plurality of traffic detection devices for acquiring traffic data, traffic data detected by the plurality of traffic detection devices can be preprocessed, before using and analyzing traffic information, to solve the problem that there are inconsistencies in such as the acquisition cycle, acquisition location, acquisition accuracy, and acquired traffic data of the plurality of traffic detection devices. The traffic parameters of the first target road section are obtained after filtering of traffic data, time-space conversion of traffic data and data conversion of traffic data, achieving the effect of improving the accuracy of traffic road information analysis.

Preferably, the processing unit includes: a first processing module, configured for filtering the traffic data of the first target road section acquired by each of the traffic detection devices respectively according to preset filter conditions to obtain the filtered traffic data acquired by each of the traffic detection devices; and a second processing module, configured for performing the time-space conversion and/or data conversion on the filtered traffic data acquired by each of the traffic detection devices to obtain the traffic parameters of the first target road section. Preferably, the filter conditions at least include one or more of the following conditions: device parameters of the traffic detection devices, vehicle speed limits for different traffic conditions, vehicle flow limits for different types of roads, the vehicle time occupancy rate, correlations between different types of traffic parameters. The preset filter conditions for different traffic data can be different, erroneous data acquired by the traffic detection devices during traffic data acquisition are filtered out by filtering the traffic data, and time-space conversion and/or data conversion is performed on the filtered traffic data, which improves the accuracy of traffic road information analysis results.

Preferably, the traffic data at least include one or more types of the following parameters: a vehicle time occupancy rate, flow saturation of vehicle flow, and a vehicle speed. Preferably, the second processing module includes: a first processing sub-module, configured for calculating the reliability of each type of parameters detected by each of the traffic detection devices within the first preset period based on detection accuracy of each of the traffic detection devices and the data amount of each type of the parameters actually acquired within the first preset period; a second processing sub-module, configured for calculating weighted average of each type of the parameters actually acquired by using the reliability of each type of parameters as weighting factors to obtain the traffic parameters of the first target road section within the first preset period; and a third processing sub-module, configured for obtaining the reliability of the traffic parameters by averaging the reliability of a same type of parameters detected by each of the traffic detection devices.

Preferably, in the case that a traffic data release period includes a plurality of time periods, each of which has a same duration as the first preset period, the apparatus further includes: a second obtaining unit, configured for obtaining the reliability of real-time traffic conditions for the first target road section within each of the time periods of the traffic data release period; a first accumulation unit, configured for accumulating the reliability of traffic conditions of a same type within each of the time periods to obtain a accumulated reliability value for each type of traffic conditions; a first selecting unit, configured for determining a traffic condition with the highest accumulated reliability value as the real-time traffic condition for the first target road section within the traffic data release period. It should be noted that it is possible for the analysis of traffic road information to avoid being influenced by the influence of the start/end of a red light and the start/end of a green light on the traffic through the above solution. Preferably, a weighting factor can be preset for each time period according to the correlation between each time period and traffic lights, and a smaller weighting factor can be preset when traffic lights change over the time period, which improves the accuracy of analysis results for road traffic conditions.

Preferably, the second obtaining unit includes: a first calculation module, configured for calculating, for each of the time periods, a proportion of time in which the traffic on the first target road section is in a passing state; a second calculation module, configured for calculating the reliability of the real-time traffic conditions for the first target section within each of the time periods based on the proportion of time in which the traffic is in the passing state and the reliability of the acquired traffic parameters of the first target road section within each of the time periods.

Preferably, in the case that a second target road section includes a plurality of spatially discontinuous road sections including the first target road section, the apparatus further includes: a third obtaining unit, configured for reading a plurality of road section weighting factors corresponding to the plurality of road sections; a calculation unit, configured for calculating the product of the weighting factor for each of the plurality of road sections and the reliability of the real-time traffic condition for a corresponding road section within the traffic data release period; a second accumulation unit, configured for accumulating the products of the road sections with a same type of traffic conditions to obtain a accumulated value for each type of traffic conditions; and a second selecting unit, configured for determining a traffic condition with the highest accumulated value as the real-time traffic condition for the second target road section within the traffic data release period. The above solution solve the problem that there are errors in the traffic condition analysis results caused by the traffic signal lights when processing the traffic road information is solved.

Preferably, in the case that the traffic data release period includes a plurality of time periods, each of which has a same duration as the first preset period, the apparatus further includes: a fourth obtaining unit, configured for reading a priority for each type of traffic conditions; and a third selecting unit, configured for determining a traffic condition with a high priority among the real-time traffic conditions for the first target road section within each of the time periods as the real-time traffic condition for the first target road section within the traffic data release period.

Preferably, the determining unit includes: a first determining module, configured for determining the membership degrees for the traffic parameters in the fuzzy rule matrix table by calling the membership function; and a second determining module, configured for determining the membership degree of each type of traffic conditions contained in the fuzzy rule matrix based on the membership degrees of the traffic parameters in the fuzzy rule matrix table.

According to another aspect of the embodiments of the present application, a terminal is provided. The terminal includes:

a processor, a memory, communication interfaces and a bus;

the processor, the memory and the communication interfaces are connected and communicate with each other via the bus;

the memory is configured to store executable program codes; and the processor is configured to execute programs corresponding to the executable program codes by reading the executable program codes stored in the memory for:

obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed;

selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table;

determining a membership degree for each type of traffic conditions contained in the first fuzzy rule matrix table by calling a membership function, wherein the traffic conditions at least include the following types: Unblocked, Slow and Congested; and comparing the membership degrees of all types of traffic conditions contained in the first fuzzy rule matrix table to determine a real-time traffic condition for the first target road section within the first preset period.

Preferably, the traffic parameters at least include any one or more of the parameters: a vehicle time occupancy rate, flow saturation of vehicle flow, and a vehicle speed. Preferably, the fuzzy rule matrix tables include any one of the following types of matrix tables: a one-dimensional fuzzy rule matrix table, a two-dimensional fuzzy rule matrix table, and a three-dimensional fuzzy rule matrix table. Preferably, the traffic conditions at least include the following types: Unblocked, Slow and Congested.

The preset traffic condition of each of units in the fuzzy rule matrix selected based on the reliability of traffic parameters can be different, achieving the objective of improving the accuracy of traffic road information analysis results. The corresponding fuzzy rule matrix table is obtained based on the number of traffic parameters and/or the reliability of traffic parameters, achieving the purpose of selecting a fuzzy rule table according to actual traffic conditions flexibly and solving the problem that a fuzzy rule table is too rigid.

According to another aspect of the embodiments of the present application, an application program is further provided. The application program is configured for carrying out the method for processing traffic road information provided by the embodiments of the present application.

According to another aspect of the embodiments of the present application further provide a storage medium for storing application program, which is configured for carrying out the method for processing traffic road information provided by the embodiments of the present application.

In the embodiments of the present application, the traffic parameters of a first target road section acquired by traffic detection devices and/or the reliability of the traffic parameters within a first preset period are obtained; a first fuzzy rule matrix table is selected from a pre-stored set of fuzzy rule matrix tables based on the number of the traffic parameters and/or the reliability of the traffic parameters of the first target road section; the membership degrees for each type of traffic conditions contained in the first fuzzy rule matrix table are determined by calling a membership function; the membership degrees of all types of traffic conditions contained in the first fuzzy rule matrix table are compared to determine a real-time traffic condition of the first target road section within the first preset period. These solves the technical problems in solutions of computing traffic states of a road by a using fuzzy rule in the prior art that analysis results for traffic road information are inaccurate due to a single fuzzy rule.

BRIEF DESCRIPTION OF THE DRAWINGS

In order to explain the technical solutions of the embodiments of the present application and the prior art more clearly, a simple introduction of the drawings required in the embodiments and the prior art will be given. Obviously, the drawings described below are just those of some embodiments of the present application and other drawings can be obtained by those of ordinary skills in the art without any creative efforts based on these drawings.

DETAILED DESCRIPTION

To make the objective, technical solution and advantages of the present application more clear, the present application is further described in detail with exemplary embodiments with reference to the drawings. Obviously, the embodiments described are merely some of the embodiments of the present application, instead of all the embodiments. All other embodiments obtained by those of ordinary skills in the art according to the embodiments herein without any creative efforts are within the scope of the present application.

It should be noted that the terms such as "first", "second" and the like in the description, claims and drawings of the present application described above are used to distinguish similar objects, and are not necessarily used to describe a specific order or sequence. It should be understood that the data used in this way are interchangeable under appropriate circumstances so that the embodiments of the present application described herein can be implemented in an order other than those illustrated or described herein. Moreover, the terms "include", "comprise" and "have" or any variants thereof are intended to cover non-exclusive inclusions. For example, processings, methods, systems, products or devices including a series of steps or units include not only those steps or units specifically listed but also those not specifically listed or intrinsic to such processings, methods, systems, products or devices.

Embodiment I

The embodiment of the present application provide a method for processing traffic road information. It should be noted that steps shown in the flowchart of the drawings can be performed by a computer system, such as a computer system that can execute a set of computer-executable instructions. Although a logical order is shown in the flowchart, in some cases, the steps shown or described can be performed in an order different from the logical order herein.

Figure 1:
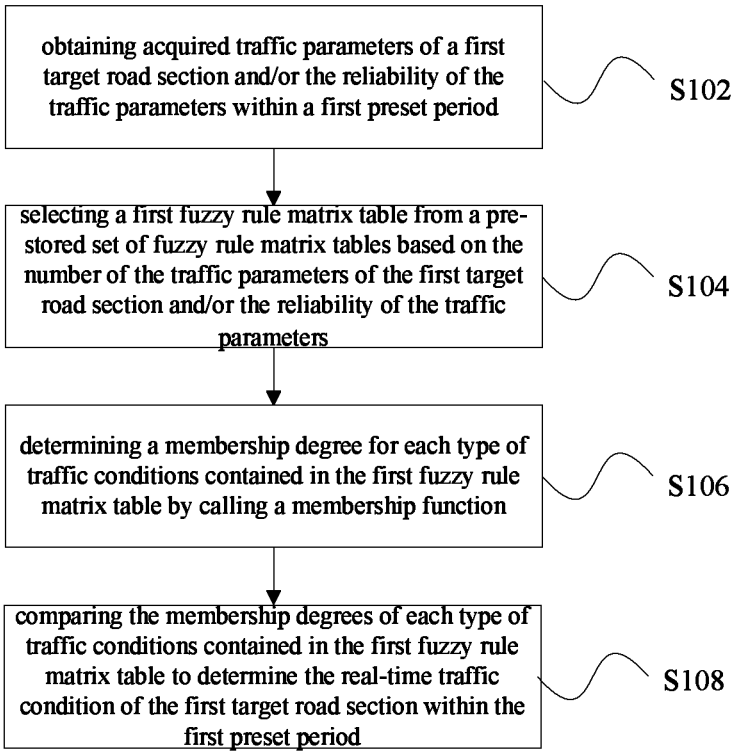
FIG. 1 is a flowchart of a method for processing traffic road information according to an embodiment of the present application.

FIG. 1 is a flow diagram of a method for processing traffic road information according to an embodiment of the present application. As shown in FIG. 1, the method includes the following steps:

Step S102, obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed.

Specifically, the first preset period can be preset, and for example can be 1 minute. The first target road section can be a predetermined section of a ground road. The traffic parameters can be acquired by a traffic detection device(s), which can be a device(s) installed on the road surface or not on the road and used to acquire traffic parameters, and which can be one or more of different types of traffic parameter acquiring devices such as a coil detector, a microwave detector, a video detector, a geomagnetic detector, a Sydney Coordinated Adaptive Traffic System (SCATS) detector and the like. The traffic detection devices can acquire traffic parameters such as road traffic flow, vehicle speed, vehicle time occupancy rate, flow saturation of vehicle flow and lane occupancy.

Step S104, selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table.

Specifically, in the embodiment of the present application, the first fuzzy rule matrix table can be obtained in accordance with the number of the traffic parameters and/or the reliability of the traffic parameters. The set of fuzzy rule matrix tables can be set and stored in advance. The set of fuzzy rule matrix tables can include a plurality of fuzzy rule matrix tables, each of which can be modified according to actual situations in order to obtain more accurate real-time traffic conditions.

It should be noted that a one-dimensional fuzzy rule matrix can be used when there is one traffic parameter acquired within the first preset period for the first target road; a two-dimensional fuzzy rule matrix can be used when there are two traffic parameters acquired within the first preset period for the first target road; a three-dimensional fuzzy rule matrix can be used when there are three traffic parameters acquired within the first preset period for the first target road. Different traffic parameters or different combination of traffic parameters correspond to different fuzzy rule matrices. For example, when the acquired traffic parameters of the first target road section include a vehicle time occupancy rate and a vehicle speed, a corresponding two-dimensional fuzzy rule matrix of vehicle time occupancy rates/vehicle speeds can be selected; when the traffic parameters of the first target road section acquired by traffic detection devices include a vehicle time occupancy rate and a flow saturation of vehicle flow, a corresponding two-dimensional fuzzy rule matrix of vehicle time occupancy rates/flow saturation of vehicle flow can be selected.

In the step S104 above, the first fuzzy rule matrix table can also be selected based on the reliability of the traffic parameters. The reliability of a traffic parameter can be determined based on the type of the traffic detection device that acquired the traffic parameter. For example, the reliability of a vehicle speed detected by a certain type of traffic detection device is 100% and the reliability of the vehicle speed detected by another type of traffic detection device is 20%. The value of the reliability of the vehicle speed detected by the two traffic detection devices are different, and when obtaining the corresponding fuzzy rule matrix based on the vehicle speeds, the preset traffic condition for each unit in the fuzzy rule matrix can be different. The preset traffic condition of each of units in the fuzzy rule matrix selected based on the reliability of traffic parameters can be different, achieving the objective of improving the accuracy of traffic road information analysis results.

It should also be noted that the first fuzzy rule matrix table can be selected from the pre-stored set of fuzzy rule matrix tables based on both the number of traffic parameters and the reliability of the traffic parameters. In this solution, the corresponding fuzzy rule matrix table is obtained based on the number of traffic parameters and/or the reliability of traffic parameters, achieving the purpose of selecting a fuzzy rule table according to actual traffic conditions flexibly and solving the problem that a fuzzy rule table is too rigid.

Step S106, determining a membership degree for each type of traffic conditions contained in the first fuzzy rule matrix table by calling a membership function, wherein the traffic conditions at least include the following types: Unblocked, Slow and Congested.

Specifically, the membership functions can be preset. Different traffic parameters have different membership function. The membership degree of traffic parameters in the fuzzy rule matrix table can be determined by using the membership functions. In an optional implementation, a membership function can be determined according to a traffic parameter threshold table having upper thresholds and lower thresholds corresponding to the traffic parameters. The membership function of a traffic parameter in different scenarios can be determined according to the lower thresholds and upper thresholds, and the membership degree of the traffic parameter in the fuzzy rule matrix tables can thereby be determined.

It should be noted that the membership degree of each type of traffic conditions in the fuzzy rule matrix table can be determined based on the membership degrees of the traffic parameters in the fuzzy rule matrix table. The membership degree of a traffic condition can be a number greater than or equal to 0 and less than or equal to 1. For example, the membership degree of Unblocked can be 1, the membership degree of Slow can be 0, and the membership degree of Congested can be 0.

Step S108, comparing the membership degrees of each type of traffic conditions contained in the first fuzzy rule matrix table to determine the real-time traffic condition of the first target road section within the first preset period.

Specifically, the real-time traffic condition of the first target road section within the first preset period can be determined by comparing the membership degrees of each type of traffic conditions. The membership degrees of each type of traffic conditions can be compared with each other, and the traffic condition with the highest membership degree can be taken as the real-time traffic condition of the first target road section within the first preset period. Optionally, the membership degree of the traffic condition can be taken as the reliability of the real-time traffic condition of the first target section within the first preset period. For example, if the membership degree of Unblocked can be 1, the membership degree of Slow can be 0, and the membership degree of Congested can be 0, it can be determined that Unblocked can be taken as the real-time traffic condition of the first target road section within the first preset period and the reliability of the real-time traffic of the first target link within the first preset period is 1.

In the Steps S102 to S108, acquired traffic parameters of a first target road section and/or the reliability of the traffic parameters within a first preset period are obtained; a first fuzzy rule matrix table is selected from a pre-stored set of fuzzy rule matrix tables based on the number of the traffic parameters and/or the reliability of the traffic parameters of the first target road section; the membership degrees for each type of traffic conditions contained in the first fuzzy rule matrix table are determined by calling a membership function; the membership degrees of all types of traffic conditions contained in the first fuzzy rule matrix table are compared to determine the real-time traffic condition of the first target road section within the first preset period. These solves the technical problems in solutions of computing traffic states of a road by a using fuzzy rule in the prior art that analysis results for traffic road information are inaccurate due to a single fuzzy rule.

In an optional solution of the embodiment of the present application, in a case where there are at least two traffic parameters of the first target road section, the reliability of the traffic parameters of the first target road section is a combination of the reliability of each of the parameters. Step S104, selecting a first fuzzy rule matrix table from a pre-stored set of fuzzy rule matrix tables based on the number of the traffic parameters of the first target road section and/or the reliability of the traffic parameters, can include:

Step S1041, obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters.

Step S1043, selecting a fuzzy rule matrix table that matches with the reliability of the traffic parameters of the first target road section from the group of fuzzy rule matrix tables to obtain the first fuzzy rule matrix table.

Specifically, in the step S1041 to step S1043, the process of selecting the first fuzzy rule matrix table based on the number of the traffic parameters can be selecting a corresponding group of fuzzy rule matrix tables based on the number of traffic parameters at first. For example, the corresponding group of fuzzy rule matrix tables can be a group of two-dimensional fuzzy rule matrix tables when there are two traffic parameters; alternatively, a corresponding fuzzy rule matrix table of vehicle time occupancy rates/vehicle speeds can be selected from the group of fuzzy rule matrix tables when the traffic parameters include a vehicle time occupancy rates and a vehicle speed.

In an optional solution of the embodiment of the present application, before the step S102, obtaining acquired traffic parameters of a first target road section and/or the reliability of the traffic parameters within a first preset period, the solution can further include:

step S1001, acquiring traffic data of the first target road section by using a plurality of traffic detection devices within the first preset period, wherein the plurality of traffic devices at least include a combination of any number of the following devices: a magnetic frequency vehicle detector, a wave frequency vehicle detector, a video vehicle detector, a coil vehicle detector, a microwave vehicle detector, a geomagnetic vehicle detector and a SCATS vehicle detector.

Specifically, the plurality of traffic devices can be fixed source traffic detection devices and combinations thereof, which can include a combination of any number of the devices: a magnetic frequency vehicle detector, a wave frequency vehicle detector, a video vehicle detector, a coil vehicle detector, a microwave vehicle detector, a geomagnetic vehicle detector and a SCATS vehicle detector. In the solution, traffic parameters are acquired by a plurality of traffic detection devices, solving the problem of inaccurate analysis results for traffic road information caused by a single data source when processing traffic road information in the prior art.

Step S1003, preprocessing the traffic data to obtain traffic parameters of the first target road section, wherein the data preprocessing includes at least any one or more of the following processings: filtering of the traffic data, time-space conversion of the traffic data, and data conversion of the traffic data.

Specifically, as there may be inconsistencies in such as the acquisition cycle, acquisition location, acquisition accuracy, and acquired traffic data of the plurality of traffic detection devices for acquiring traffic data, traffic data detected by the plurality of traffic detection devices can be preprocessed, before using and analyzing traffic information, to solve the problem that there are inconsistencies in such as the acquisition cycle, acquisition location, acquisition accuracy, and acquired traffic data of the plurality of traffic detection devices. The traffic parameters of the first target road section are obtained after filtering of traffic data, time-space conversion of traffic data and data conversion of traffic data, achieving the effect of improving the accuracy of traffic road information analysis.

It should be noted that the traffic data acquired by traffic detection devices can be filtered according to the characteristics of the traffic data and the correlation between the traffic data. For example, filtering the device parameters of the traffic data acquisition devices can include filtering data according to a specific period, filtering data according to a designated area, or filtering data according to the availability of the traffic data acquisition devices. Alternatively, different traffic data can be separately filtered according to a preset range of the vehicle speed, a preset range of the flow saturation of the traffic flow, or a preset range of the vehicle time occupancy rate. The vehicle flow needs to be converted to hour flow. The conversion can be done by multiplying the detected flow by 3600 seconds and then divided by the detection period (seconds). The range of the hour flow can be set to different values according to different road types. The hour flow conversion and flow filtering may not be performed on the vehicle flow detected by a SCATS vehicle detector. Alternatively, for the filtering of two or three types of traffic data, the range for the data to be filtered is preset. For example, by filtering the traffic data, the following data are deleted: data with a vehicle time occupancy rate greater than 95% and a vehicle speed greater than a reasonable threshold, or with a vehicle speed equal to zero and a vehicle flow not equal to zero, or with a vehicle time occupancy rate equal to zero and a vehicle flow greater than a reasonable threshold, or with a vehicle speed or a vehicle time occupancy rate not equal to zero when the vehicle flow equal to zero.

It should also be noted that the time-space conversion of the traffic data can be performed according to the location and the acquisition cycle of the traffic detection devices, and the traffic data acquired by the traffic detection devices are converted into data with a same time dimension and different spatial dimensions.

It should also be noted that the data conversion of traffic data can convert the traffic data into weighted average flow saturation of vehicle flow for a single lane, weighted average vehicle speed of the target road section, or weighted average vehicle time occupancy rate. The weighting factor can be the reliability of the traffic parameters and can be calculated based on the sample data amount and the detection accuracy of the traffic detection devices. For example: a) flow data of a single lane are converted to weighted average flow data for the single lane and then converted to weighted average flow saturation of vehicle flow for the single lane (by dividing the weighted average flow data for the single lane by the maximum weighted average flow for a single lane). b) vehicle speeds over a cross-section of a single lane is converted into a weighted average speed over the cross-section. c) time occupancy ratios of a single lane is converted into a weighted average time occupancy ratio. d) for each type of traffic parameters, the corresponding weighted factors are averaged to obtain the reliability of the type of the traffic parameters.

In an alternative solution of the embodiments of the present application, the step S1003, preprocessing the traffic data to obtain traffic parameters of the first target road section can include:

Step S10031, filtering the traffic data of the first target road section acquired by each of the traffic detection devices according to preset filter conditions respectively to obtain the filtered traffic data acquired by each of the traffic detection devices, wherein the filter condition at least include any one or more of the following conditions: device parameters of the traffic detection devices, vehicle speed limits for different traffic conditions, vehicle flow limits for different types of roads, vehicle time occupancy rate, correlation between different types of traffic parameters.

Step S10033, performing the time-space conversion and/or data conversion on the filtered traffic data acquired by each of the traffic detection devices to obtain the traffic parameters of the first target road section.

Specifically, the preset filter conditions for different traffic data can be different, erroneous data acquired by the traffic detection devices during traffic data acquisition are filtered out by filtering the traffic data, and time-space conversion and/or data conversion is performed on the filtered traffic data, which improves the accuracy of traffic road information analysis results.

In an alternative solution of the embodiments of the present application, the traffic data include at least any one or more of the following parameters: a vehicle time occupancy rate, flow saturation of vehicle flow, and a vehicle speed. The step S10033, performing data conversion on the filtered traffic data acquired by each of the traffic detection devices to obtain the traffic parameters of the first target road section, can include:

step S10035, calculating the reliability of each type of parameters detected by each of the traffic detection devices within the first preset period based on detection accuracy of each of the traffic detection devices and the data amount of each type of the parameters actually acquired within the first preset period.

Step S10037, calculating weighted average of each type of the parameters actually acquired by using the reliability of each type of parameters as weighting factors to obtain the traffic parameters of the first target road section within the first preset period.

The reliability of the traffic parameters is obtained by averaging the reliability of a same type of parameters detected by each of the traffic detection devices.

Specifically, in the case that the detection period of any traffic detection device is less than or equal to the first preset period, the first preset period is determined according to the detection period. After calculating the reliability of each type of parameters detected by all traffic detection devices in each detection period, each type of parameters detected by all traffic detection devices in the first preset period is obtained by calculating the average value of the reliability of each type of parameters detected by all traffic detection devices in each detection period.

In an alternative solution of the embodiments of the present application, when the traffic data release period includes a plurality of time periods, each of which has a same duration as the first preset period, after the step S108, comparing the membership degrees of each type of traffic conditions contained in the first fuzzy rule matrix table to determine the real-time traffic condition of the first target road section within the first preset period, the method can further include:

Step S1091, obtaining the reliability of real-time traffic conditions for the first target road section within each of the time periods of the traffic data release period.

Specifically, the traffic data release period can be preset, for example 5 minutes. When the duration of the first preset period is 1 minute, the traffic data release period can include five time periods with 1 minute duration. For the five time periods with a duration of 1 minute, the method for processing the traffic parameters acquired for the first target road section within the time periods to obtain real-time traffic conditions for the first target road section within the time periods can be the same.

It should be noted that a weighting factor can be preset for each time period according to the correlation between each time period and traffic lights, and a smaller weighting factor can be preset when traffic lights change over the time period, which improves the accuracy of analysis results for road traffic conditions.

Step S1092, accumulating the reliability of traffic conditions of a same type within each of the time periods to obtain a accumulated reliability value for each type of traffic conditions.

Step S1093, determining a traffic condition with the highest accumulated reliability value as the real-time traffic condition for the first target road section within the traffic data release period.

Specifically, the reliability of traffic condition with the same type are accumulated. For example, if the traffic data release period includes 5 time periods with 1 minute duration and the real-time traffic condition and confidence within each of the time periods are Unblocked (0.7), Slow (0.1), Slow (0.3), Congested (0.1) and Congested (0.1), the reliability of each type of traffic conditions obtained by accumulating the reliability of traffic conditions of a same type are: Unblocked (0.7), Slow (0.4), Congested (0.2). The real-time traffic condition of the first target road section within the traffic data release period is determined as the traffic condition "Unblocked" with the highest membership degree of "0.7".

It should be noted that it is possible for the analysis of traffic road information to avoid being influenced by the influence of the start/end of a red light and the start/end of a green light on the traffic by performing the above steps S1091 to S1093 in the embodiment of the present application.

In an optional solution of the embodiment of the present application, step S1091, obtaining the reliability of real-time traffic conditions for the first target road section within each of the time periods of the traffic data release period, can include:

Step S10911, calculating, for each of the time periods, the proportion of time in which the traffic on the first target road section is in a passing state.

Step S10913, calculating the reliability of the real-time traffic conditions for the first target section within each of the time periods based on the proportion of time in which the traffic is in the passing state and the reliability of the acquired traffic parameters of the first target road section within each of the time periods.

Specifically, in the steps S10911 to S10913, the passing state of the traffic on the first target road section can be the state where vehicles proceed with the traffic lights on the first target road section displaying green light. That is, the traffic is in passing state when the traffic lights display green light, and the traffic is in stopped state when the traffic lights display red light. The stopped state and the congested traffic condition are different. The stopped state is a state where vehicles follow the traffic rules and are stopped when the traffic lights display red light. The congested traffic condition is a state where vehicles move slowly because of too many vehicles on a road section.

Optionally, the proportion X % of time can be calculated by the following first formula, $$X\ \% = \frac{t_1}{T},$$

wherein T is the duration of each time period, $t_1$ is the sum of the duration during which the traffic lights display green light within each time period.

Optionally, the proportion X % of time can also be calculated by the following second formula, $$X\ \% = \frac{T - t_2}{T},$$

wherein T is the duration of each time period, $t_2$ is the sum of the duration during which the traffic lights display red light within each time period.

It should be noted that the reliability of the real-time traffic condition on the first target road section can be calculated from the proportion of time and the reliability of the traffic parameters of this road section. The real-time traffic conditions obtained from analysis can be evaluated directly by calculating the reliability of real-time traffic conditions. The higher the confidence, the more accurate the analysis results of the real-time traffic conditions can be.

In an alternative solution of the embodiments of the present application, when a second target road section includes a plurality of spatially discontinuous road sections including the first target road section, after the step S1093, determining a traffic condition with the highest accumulated reliability value as the real-time traffic condition for the first target road section within the traffic data release period, the method can further include:

Step S1094, reading a plurality of road section weighting factors corresponding to the plurality of road sections.

Specifically, in an optional solution provided in the embodiments, a weighting factor can be provided for a road section to improve the accuracy of the analysis results of the traffic condition. A road section weighting factor is preset for each road section in the second target road section. For a road section close to an intersection of the traffic road, traffic lights will have a great impact on the traffic parameters, thus a smaller weighting factor can be set for such road section. A larger weighting factor can be set for a section far away from an intersection in the traffic road. These improves the accuracy of the analysis of traffic conditions.

Step S1095, calculating the product of the weighting factor for each of the plurality of road sections and the reliability of the real-time traffic condition for the corresponding road section within the traffic data release period.

Step S1096, accumulating the products of all road sections having a same type of traffic conditions to obtain a accumulated value for each type of traffic conditions.

Step S1097, determining a traffic condition with the highest accumulated value as the real-time traffic condition for the second target road section within the traffic data release period.

Specifically, the product of the weight for any road section and the reliability of the real-time traffic corresponding to this road section is calculated. The products then are added up according to the type of the traffic conditions. The real-time traffic condition of the second target road section within the traffic data release period is determined as the traffic condition with the highest accumulated value.

In an alternative solution of the embodiments of the present application, when the traffic data release period includes a plurality of time periods, each of which has a same duration as the first preset period, after the step S108, comparing the membership degrees of each type of traffic conditions contained in the first fuzzy rule matrix table to determine the real-time traffic condition of the first target road section within the first preset period, the method can further include:

Step S1101, reading a priority for each type of traffic conditions.

Specifically, the priority for each type of traffic conditions can be preset, for example, the priority can include a high priority, a medium priority and a low priority.

Step S1102, determining a traffic condition with a high priority among the real-time traffic conditions for the first target road section within each of the time periods as the real-time traffic condition for the first target road section within the traffic data release period.

Specifically, for example, Unblocked is provided with a high priority, Congested is provided with a low priority, and Slow is provided with a medium priority. Among a plurality of time periods of the traffic data release period, if the real-time traffic conditions in a time period includes Unblocked, the real-time traffic condition for the first target road section within the traffic data release period is determined as being Unblocked; if the real-time traffic conditions in a time period includes a Slow and Congested, the real-time traffic condition for the first target road section within the traffic data release period is determined as being Slow; and if the traffic within the plurality of the time period are all Congested, the real-time traffic condition for the first target road section within the traffic data release period is determined as being Congested. In the embodiment of the present application, the steps S1101 to S1102 solve the problem that there are errors in the traffic condition analysis results caused by the traffic signal lights when processing the traffic road information is solved.

In an alternative solution of the embodiments of the present application, the step S106, determining a membership degree for each type of traffic conditions contained in the first fuzzy rule matrix table by calling a membership function, can include:

Step S1061, determining the membership degrees for the traffic parameters in the fuzzy rule matrix table by calling a membership function, Specifically, the step S1061 can include steps S10611 to S10615.

Step S10611, obtaining lower thresholds and upper thresholds corresponding to the traffic parameters from a preset traffic parameter threshold table, and determining the membership function for traffic parameters in different scenarios based on the lower thresholds and upper thresholds.

Specifically, the traffic parameter threshold table can be preset, such as shown in Table I. In an implementation of the present application, in order to improve the accuracy of traffic road information analysis results, different upper and lower thresholds can be preset for different types of traffic roads. As can be seen from Table I, in the road information analysis, when the traffic parameter is the vehicle speed, the lower threshold for the speed on a primary main road can be 12 km/h and the upper threshold can be 25 km/h, and the lower threshold for the speed on an expressway can be 20 km/h and the upper threshold can be 45 km/h.

TABLE I

| | vehicle speed (km/h) | flow saturation of vehicle flow | vehicle time occupancy rate | average headway time (s) |
|---|---|---|---|---|
| expressway | 20-45 | 0.3-0.6 | 50%-75% | 0.5-1.5 |
| primary main road | 12-25 | 0.25-0.5 | 50%-75% | 0.5-1.5 |
| secondary main road | 10-23 | 0.2-0.4 | 50%-75% | 0.5-1.5 |
| access road | 8-20 | 0.15-0.3 | 50%-75% | 0.5-1.5 |

Figure 2:
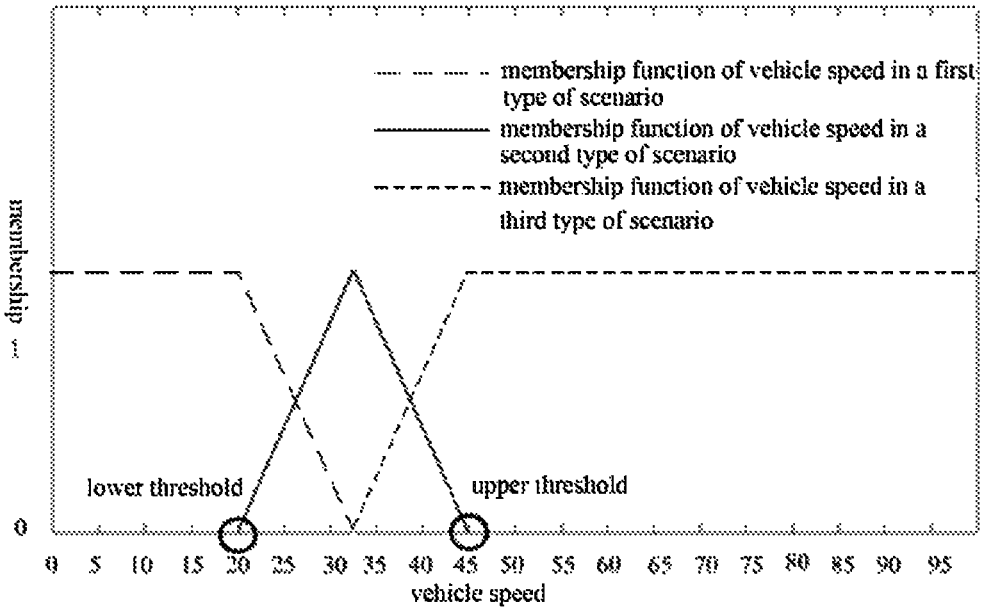
FIG. 2 is an exemplary membership function of vehicle speed according to an embodiment of the present application.

It should be noted that the membership function of the vehicle speed can be as shown in FIG. 2 when the traffic parameter is the vehicle speed and the scenarios include the first type of scenario, the second type of scenario and the third type scenario. In FIG. 2, the lower threshold of the vehicle speed is 20 km/h; the upper threshold of the vehicle speed is 45 km/h; and the membership function of the vehicle speed in the first type of scenario, the second type of scenario and the third type scenario are shown in FIG. 2.

Step S10613, obtaining the membership degree of a traffic parameter in different scenarios by applying the corresponding function to the traffic parameter respectively.

Specifically, according to the membership function of the vehicle speed in FIG. 2, if the vehicle speed of an expressway is 50 km/h, the corresponding membership degree in the first type of scenario can be 0, the corresponding membership degree in the second type of scenario can be 0, and the corresponding membership degree in the third type of scenario can be 1.

Step S10615, saving the membership degrees of the traffic parameter in different scenarios to a fuzzy rule matrix table, wherein the fuzzy rule matrix table contains a plurality of units, and the membership degrees of the traffic parameter in different scenarios are saved to different units respectively.

Specifically, for example, the different scenarios include the first type of scenario, the second type of scenario and the third type of scenario, the vehicle speed of an expressway is 50 km/h, and the vehicle time occupancy rate is 50%, the membership degrees of the traffic parameter are saved to different units in the fuzzy rule matrix table according to the corresponding membership function, as shown in table II.

TABLE II

| membership degree | the first type of scenario | the second type of scenario | the third type of scenario |
|---|---|---|---|
| vehicle speed (50 km/h) | 0 | 0 | 1 |
| vehicle time occupancy rate (50%) | 1 | 0 | 0 |

| | vehicle time occupancy rate | | |
|---|---|---|---|
| vehicle speed | the first type of scenario | the second type of scenario | the third type of scenario |
| the first type of scenario | slow (0, 1) | congested (0, 0) | congested (0, 0) |
| the second type of scenario | unblocked (0, 1) | slow (0, 0) | congested (0, 0) |
| the third type of scenario | unblocked (1, 1) | unblocked (1, 0) | slow (1, 0) |

In an optional scenario, the step S10613, obtaining the membership degree of a traffic parameter in different scenarios by applying the corresponding function to the traffic parameter respectively, can be: when the traffic parameter is less than the lower threshold, the membership degree of the traffic parameter to the first type of scenario is determined as 1, the membership of the traffic parameter to the second type of scenario is determined as 0, and the membership of the traffic parameter to the third type of scenario is determined as 0. When the traffic parameter is greater than the lower threshold and less than the midpoint threshold, the membership of the traffic parameter to the first type of scenario is determined according to a first calculation model, the membership of the traffic parameter to the second type of scenario is determined according to a second calculation model, the membership of the traffic parameter to the third type of scenario is determined as 0, wherein the midpoint threshold is the average of the lower threshold and the upper threshold. When the traffic parameter is greater than the midpoint threshold and less than the upper threshold, the membership of the traffic parameter to the first type of scenario is determined as 0, the membership of the traffic parameter to the second type of scenario is determined according to a third calculation model, the membership of the traffic parameter to the third type of scenario is determined according to a fourth calculation model. When the traffic parameter is greater than the upper threshold, determining the membership degree of the traffic parameter to the first type of scenario as 0, the membership of the traffic parameter to the second type of scenario as 0, and the membership of the traffic parameter to the third type of scenario as 1. The midpoint threshold can be the average of the lower and upper thresholds for the traffic parameter. Optionally, the midpoint threshold can also be set according to the actual situations, and can be any preset threshold that can be used for properly handling traffic road information.

In an alternative solution of the embodiments of the present application, the membership degree of a traffic parameter to the first type of scenario is calculated according to the first calculation model $f_1$:

$$f_1 = \frac{a+b-2x}{b-a},$$

wherein a is the lower threshold, b is the upper threshold, and x is the value of the traffic parameter; the membership degree of a traffic parameter to the second type of scenario is calculated according to the second calculation model $$f_2:\ f_2 = \frac{2x-2a}{b-a},$$

wherein a is the lower threshold, b is the upper threshold, and X is the value of the traffic parameter; the membership degree of a traffic parameter to the second type of scenario is calculated according to the third calculation model $$f_3{:}f_3 = \frac{2b-2x}{b-a},$$

wherein a is the lower threshold, b is the upper threshold, and x is the value of the traffic parameter; and the membership degree of a traffic parameter to the third type of scenario is calculated according to the fourth calculation model $f_4$:

$$f_4 = \frac{2x-a-b}{b-a},$$

wherein a is the lower threshold, b is the upper threshold, and x is the value of the traffic parameter.

Specifically, an equivalent replacement approach to calculate the membership degree of a traffic parameter in different scenarios in the value range can be:

(1) The First Type of Scenario

If $0 \le x < a$, the membership degree of the traffic parameter to the first type of scenario is determined as 1; if $$a < x \le \frac{a+b}{2},$$

the membership of the traffic parameter to the first type of scenario is determined as $$f_1 = \frac{a+b=2x}{b-a};$$

and if $$x > \frac{a+b}{2},$$

the membership of the traffic parameter to the first type of scenario is determined as 0.

(2) The Second Type of Scenario

If $0 \le x < a$, the membership degree of the traffic parameter to the second type of scenario is determined as 0; if $$a < x \le \frac{a+b}{2},$$

the membership of the traffic parameter to the second type of scenario is determined as $$f_2 = \frac{2x = 2a}{b - a};$$

if $$\frac{a+b}{2} < x \le b,$$

the membership of the traffic parameter to the second type of scenario is determined as $$f_3 = \frac{2b - 2x}{b - a};$$

and if x>b, the membership of the traffic parameter to the second type of scenario is determined as 0.

(3) The Third Type of Scenario

If $$0 \le x < \frac{a+b}{2},$$

the membership degree of the traffic parameter to the third type of scenario is determined as 0; if $$\frac{a+b}{2} < x \le b,$$

the membership of the traffic parameter to the third type of scenario is determined as $$f_4 = \frac{2x - a - b}{b - a};$$

and if x>b, the membership of the traffic parameter to the third type of scenario is determined as 1.

Step S1063, determining the membership degree of each type of traffic conditions contained in the fuzzy rule matrix based on the membership degrees of the traffic parameters in the fuzzy rule matrix table.

Specifically, the step S1063 can include steps S10631 to S10637.

Step S10631, obtaining the membership degrees of a traffic parameter in the fuzzy rule matrix table.

Step S10633, processing the membership degrees of the traffic parameter in different scenarios contained in each of units according to a first preset rule to obtain a preset membership degree for the traffic condition in the unit.

Specifically, the first preset rule can be: when the fuzzy rule matrix table is a one-dimensional fuzzy rule matrix table, the membership degree of the traffic parameter contained in each of the units in the fuzzy rule matrix table is determined as the preset membership degree for the traffic condition in the unit; when the fuzzy rule matrix table is a multi-dimensional fuzzy rule matrix table, the minimum membership degree of the traffic parameter contained in each of the units is determined as the preset membership degree for the traffic condition in the unit. For example, for Table II, the two-dimensional fuzzy rule matrix table on vehicle speeds/vehicle occupancy, the membership degrees of the traffic parameters in different scenarios contained in each of the units in Table 2 are processed according to the above first preset rule to obtain the preset membership degree for the traffic condition in the unit in the fuzzy rule matrix table, such as shown in Table III.

TABLE III

| | vehicle time occupancy rate | | |
|---|---|---|---|
| vehicle speed | the first type of scenario | the second type of scenario | the third type of scenario |
| the first type of scenario | slow (0) | congested (0) | congested (0) |
| the second type of scenario | unblocked (0) | slow (0) | congested (0) |
| the third type of scenario | unblocked (1) | unblocked (0) | slow (0) |

Step S10635, aggregating the membership degree in each of the units in the fuzzy rule matrix table for each type of traffic conditions to obtain the aggregation result of the membership degrees for each type of traffic conditions.

Specifically, in a one-dimensional or multi-dimensional fuzzy rule matrix table, there are a plurality of membership degrees for one type of traffic conditions in the units of the fuzzy rule matrix table. The aggregation result of the membership degrees for a same type of traffic conditions can be obtained by aggregating the membership degrees of the type of traffic condition. For example, as shown in Table III, there are three membership degrees for Unblocked, which are unblocked (0), unblocked (0) and Unblocked (1). The aggregation result Unblocked (1) can be obtained by aggregating the above three membership degrees.

It should be noted that aggregation performed on a same type of traffic conditions can be that the maximum membership degree for the same type of traffic conditions is determined as the membership degree for this traffic condition. For example, the aggregation result obtained by performing aggregation on Table III can be shown as Table IV.

TABLE IV

| traffic condition | membership degree |
|---|---|
| unblocked | 1 |
| slow | 0 |
| congested | 0 |

Step S10637, comparing the membership degrees of each type of traffic condition, and determining a traffic condition with the maximum membership degree as the real-time traffic condition for the first target road section within the first preset period.

Specifically, taking the membership degrees for each type of traffic conditions in Table IV as an example, it is determined by the step S10637 that the maximum membership degree in the membership degrees of the three types of traffic condition is 1, and the type of the traffic condition corresponding to the membership degree is Unblocked.

It should be noted that when there are two or more maximum membership degrees, the relatively unobstructed traffic condition can be selected as the real-time traffic condition for the first target road section within the first preset period. For example, the relatively unobstructed traffic condition can be selected as follows: if the values of the membership degree for Unblocked and for Slow are the same, Unblocked is selected as the real-time traffic condition for the first target road section within the first preset period.

In an alternative solution of the embodiments of the present application, after the step S1097, determining a traffic condition with the highest accumulated value as the real-time traffic condition for the second target road section within the traffic data release period, the method can further include:

Step S1098, determining the reliability of the real-time traffic condition of the second target road section within the traffic data release period as the accumulated value of the calculation result for the traffic conditions.

Figure 3A:
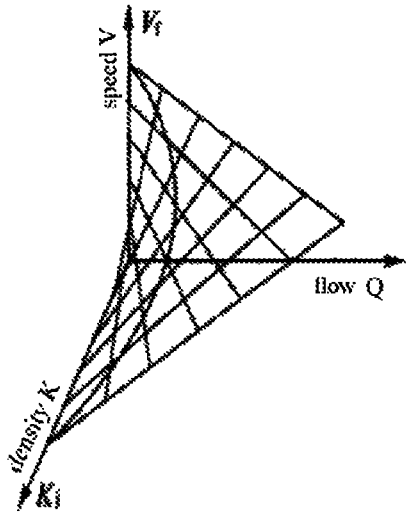
FIG. 3*a* is an exemplary graph of a traffic flow model when processing traffic road information according to an embodiment of the present application.
Figure 3B:
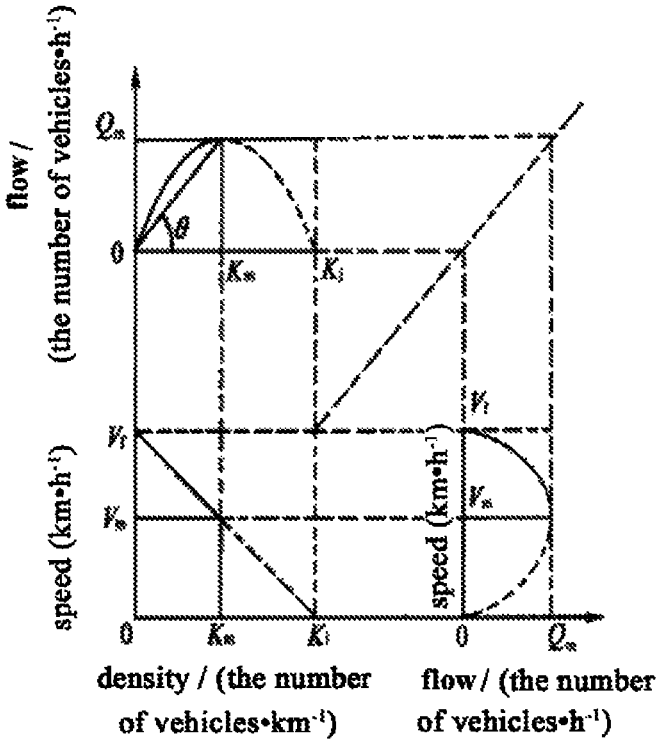
FIG. 3*b* is an exemplary graph of the correlation between traffic parameters when processing traffic road information according to an embodiment of the present application.

Specifically, the embodiment of the present application provides, taking Table II as an example, a method for obtaining traffic road information by traffic parameter analysis in a case where the traffic parameters are the vehicle speed and vehicle occupancy. For traffic parameters including one parameter, two parameters but different from the case including vehicle speed and vehicle occupancy, or three parameters, the analysis process is the same as the analysis process including the vehicle speed and vehicle occupancy in this embodiment, and a one-dimensional fuzzy rule matrix table, a two-dimensional fuzzy rule matrix table, or a three-dimensional fuzzy rule matrix table can be used. The two-dimensional fuzzy rule matrix table and three-dimensional fuzzy rule matrix table can be formulated referring to the flow-density curve shown in FIG. 3*a* and FIG. 3*b*. In FIG. 3*a* and FIG. 3*b*, the speed can be the vehicle speed in the embodiment of the present application, the flow can be the number of vehicles passing in a unit interval, and the density can be the number of vehicles in a unit distance. In FIG. 3*a*, Q=V·K, wherein Q denotes flow, K denotes density, and V denotes speed. In FIG. 3*b*, tan $$\theta = \frac{Q_m}{K_m} = V_m,$$

the graph of Q-K, V-Q and V-K relationship can be obtained in FIG. 3*b*.

Embodiment II

The embodiments of the present application provide an apparatus for processing traffic road information. It should be noted that the apparatus for processing traffic road information can be used for implementing the method for processing traffic road information according to the embodiments of the present application, and the method for processing traffic road information according to the embodiments of the present application can be executed by the apparatus for processing traffic road information, what has been descried with regard to the method embodiments of the present application will not be repeated herein.

Figure 4:
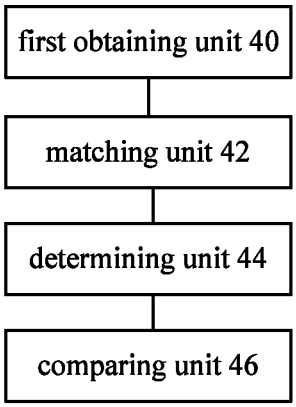
FIG. 4 is a schematic diagram of an apparatus for processing traffic road information according to the embodiment II of the present application.

FIG. 4 is a schematic diagram of an apparatus for processing traffic road information according to the embodiment II of the present application. As shown in FIG. 4, the apparatus includes:

a first obtaining unit 40, configured for obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed.

Specifically, the first preset period can be preset, and for example can be 1 minute. The first target road section can be a predetermined section of a ground road. The traffic parameters can be acquired by a traffic detection device(s), which can be a device(s) installed on the road surface or not on the road and used to acquire traffic parameters, and which can be one or more of different types of traffic parameter acquiring devices such as a coil detector, a microwave detector, a video detector, a geomagnetic detector, a SCATS detector and the like. The traffic detection devices can acquire traffic parameters such as road traffic flow, vehicle speed, vehicle time occupancy rate, flow saturation of vehicle flow and lane occupancy.

A matching unit 42, configured for selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table.

Specifically, in the embodiment of the present application, the first fuzzy rule matrix table can be obtained in accordance with the number of the traffic parameters and/or the reliability of the traffic parameters. The set of fuzzy rule matrix tables can be set and stored in advance. The set of fuzzy rule matrix tables can include a plurality of fuzzy rule matrix tables, each of which can be modified according to actual situations in order to obtain more accurate real-time traffic conditions.

It should be noted that a one-dimensional fuzzy rule matrix can be used when there is one traffic parameter acquired within the first preset period for the first target road; a two-dimensional fuzzy rule matrix can be used when there are two traffic parameters acquired within the first preset period for the first target road; a three-dimensional fuzzy rule matrix can be used when there are three traffic parameters acquired within the first preset period for the first target road. Different traffic parameters or different combination of traffic parameters correspond to different fuzzy rule matrices. For example, when the acquired traffic parameters of the first target road section include a vehicle time occupancy rate and a vehicle speed, a corresponding two-dimensional fuzzy rule matrix of vehicle time occupancy rates/vehicle speeds can be selected; when the traffic parameters of the first target road section acquired by traffic detection devices include a vehicle time occupancy rate and a flow saturation of vehicle flow, a corresponding two-dimensional fuzzy rule matrix of vehicle time occupancy rates/flow saturation of vehicle flow can be selected.

It should be noted that the matching unit 42 can select a first fuzzy rule matrix table according to the reliability of the traffic parameters. The reliability of a traffic parameter can be determined according to the type of the traffic detection device that acquired the traffic parameter. For example, the reliability of vehicle speeds detected by some type of traffic detection device is 100% and the reliability of vehicle speeds detected by other type of traffic detection device is 20%. The value of the reliability of the vehicle speed detected by the two traffic detection devices are different, and when obtaining the corresponding fuzzy rule matrix based on the vehicle speeds, the preset traffic condition for each unit in the fuzzy rule matrix can be different. The preset traffic condition of each of units in the fuzzy rule matrix selected based on the reliability of traffic parameters can be different, achieving the objective of improving the accuracy of traffic road information analysis results.

It should also be noted that the first fuzzy rule matrix table can be selected from the pre-stored set of fuzzy rule matrix tables based on both the number of traffic parameters and the reliability of the traffic parameters. In this solution, the corresponding fuzzy rule matrix table is obtained based on the number of traffic parameters and/or the reliability of traffic parameters, achieving the purpose of selecting a fuzzy rule table according to actual traffic conditions flexibly and solving the problem that a fuzzy rule table is too rigid.

A determining unit 44, configured for determining a membership degree for each type of traffic conditions contained in the first fuzzy rule matrix table by calling a membership function, wherein the traffic conditions at least include the following types: Unblocked, Slow and Congested.

Specifically, the membership functions can be preset. Different traffic parameters have different membership function. The membership degree of traffic parameters in the fuzzy rule matrix table can be determined by using the membership functions. In an optional implementation, a membership function can be determined according to a traffic parameter threshold table having upper thresholds and lower thresholds corresponding to the traffic parameters. The membership function of a traffic parameter in different scenarios can be determined according to the lower thresholds and upper thresholds, and the membership degree of the traffic parameter in the fuzzy rule matrix tables can thereby be determined.

It should be noted that the membership degree of each type of traffic conditions in the fuzzy rule matrix table can be determined based on the membership degrees of the traffic parameters in the fuzzy rule matrix table. The membership degree of a traffic condition can be a number greater than or equal to 0 and less than or equal to 1. For example, the membership degree of Unblocked can be 1, the membership degree of Slow can be 0, and the membership degree of Congested can be 0.

A comparing unit 46, configured for comparing the membership degrees of each type of traffic conditions contained in the first fuzzy rule matrix table to determine the real-time traffic condition of the first target road section within the first preset period.

Specifically, the real-time traffic condition of the first target road section within the first preset period can be determined by comparing the membership degrees of each type of traffic conditions. The membership degrees of each type of traffic conditions can be compared with each other, and the traffic condition with the highest membership degree can be taken as the real-time traffic condition of the first target road section within the first preset period. Optionally, the membership degree of the traffic condition can be taken as the reliability of the real-time traffic condition of the first target section within the first preset period. For example, if the membership degree of Unblocked can be 1, the membership degree of Slow can be 0, and the membership degree of Congested can be 0, it can be determined that Unblocked can be taken as the real-time traffic condition of the first target road section within the first preset period and the reliability of the real-time traffic of the first target link within the first preset period is 1.

In the embodiment II of the present application, the first obtaining unit 40 is configured for obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed; the matching unit 42 is configured for selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table; the determining unit 44 is configured for determining a membership degree for each type of traffic conditions contained in the first fuzzy rule matrix table by calling a membership function, wherein the traffic conditions at least include the following types: Unblocked, Slow and Congested; and the comparing unit 46 is configured for comparing the membership degrees of each type of traffic conditions contained in the first fuzzy rule matrix table to determine the real-time traffic condition of the first target road section within the first preset period. These solves the technical problems in solutions of computing traffic states of a road by using fuzzy rules in the prior art that analysis results for traffic road information are inaccurate due to a single fuzzy rule.

In an optional solution of the embodiment of the present application, in a case where there are at least two traffic parameters of the first target road section, the reliability of the traffic parameters of the first target road section is a combination of the reliability of each of the parameters. In this case, the matching unit 42 can include:

a obtaining module, configured for obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters;

a matching module, configured for selecting a fuzzy rule matrix table that matches with the reliability of the traffic parameters of the first target road section from the group of fuzzy rule matrix tables to obtain the first fuzzy rule matrix table.

Specifically, the process of selecting the first fuzzy rule matrix table based on the number of the traffic parameters can be selecting a corresponding group of fuzzy rule matrix tables based on the number of traffic parameters at first. For example, the corresponding group of fuzzy rule matrix tables can be a group of two-dimensional fuzzy rule matrix tables when there are two traffic parameters; alternatively, a corresponding fuzzy rule matrix table of vehicle time occupancy rates/vehicle speeds can be selected from the group of fuzzy rule matrix tables when the traffic parameters include a vehicle time occupancy rates and a vehicle speed.

In an alternative solution of the embodiments of the present application, the apparatus can further include:

an acquiring unit, configured for acquiring traffic data of the first target road section by using a plurality of traffic detection devices within the first preset period, wherein the plurality of traffic devices at least include a combination of any number of the following devices: a magnetic frequency vehicle detector, a wave frequency vehicle detector, a video vehicle detector, a coil vehicle detector, a microwave vehicle detector, a geomagnetic vehicle detector and a SCATS vehicle detector.

Specifically, the plurality of traffic devices can be fixed source traffic detection devices and combinations thereof, which can include a combination of any number of the devices: a magnetic frequency vehicle detector, a wave frequency vehicle detector, a video vehicle detector, a coil vehicle detector, a microwave vehicle detector, a geomagnetic vehicle detector and a SCATS vehicle detector. In the solution, traffic parameters are acquired by a plurality of traffic detection devices, solving the problem of inaccurate analysis results for traffic road information caused by a single data source when processing traffic road information in the prior art.

A processing unit, configured for preprocessing the traffic data to obtain traffic parameters of the first target road section, wherein the data preprocessing includes at least any one or more of the following processings: filtering of the traffic data, time-space conversion of the traffic data, and data conversion of the traffic data.

Specifically, as there may be inconsistencies in such as the acquisition cycle, acquisition location, acquisition accuracy, and acquired traffic data of the plurality of traffic detection devices for acquiring traffic data, traffic data detected by the plurality of traffic detection devices can be preprocessed, before using and analyzing traffic information, to solve the problem that there are inconsistencies in such as the acquisition cycle, acquisition location, acquisition accuracy, and acquired traffic data of the plurality of traffic detection devices. The traffic parameters of the first target road section are obtained after filtering of traffic data, time-space conversion of traffic data and data conversion of traffic data, achieving the effect of improving the accuracy of traffic road information analysis.

It should be noted that the traffic data acquired by traffic detection devices can be filtered according to the characteristics of the traffic data and the correlation between the traffic data. For example, filtering the device parameters of the traffic data acquisition devices can include filtering data according to a specific period, filtering data according to a designated area, or filtering data according to the availability of the traffic data acquisition devices. Alternatively, different traffic data can be separately filtered according to a preset range of the vehicle speed, a preset range of the flow saturation of the traffic flow, or a preset range of the vehicle time occupancy rate. The vehicle flow needs to be converted to hour flow. The conversion can be done by multiplying the detected flow by 3600 seconds and then divided by the detection period (seconds). The range of the hour flow can be set to different values according to different road types. The hour flow conversion and flow filtering may not be performed on the vehicle flow detected by a SCATS vehicle detector. Alternatively, for the filtering of two or three types of traffic data, the range for the data to be filtered is preset. For example, by filtering the traffic data, the following data are deleted: data with a vehicle time occupancy rate greater than 95% and a vehicle speed greater than a reasonable threshold, or with a vehicle speed equal to zero and a vehicle flow not equal to zero, or with a vehicle time occupancy rate equal to zero and a vehicle flow greater than a reasonable threshold, or with a vehicle speed or a vehicle time occupancy rate not equal to zero when the vehicle flow equal to zero.

It should also be noted that the time-space conversion of the traffic data can be performed according to the location and the acquisition cycle of the traffic detection devices, and the traffic data acquired by the traffic detection devices are converted into data with a same time dimension and different spatial dimensions.

It should also be noted that the data conversion of traffic data can convert the traffic data into weighted average flow saturation of vehicle flow for a single lane, weighted average vehicle speed of the target road section, or weighted average vehicle time occupancy rate. The weighting factor can be the reliability of the traffic parameters and can be calculated based on the sample data amount and the detection accuracy of the traffic detection devices. For example: a) flow data of a single lane are converted to weighted average flow data for the single lane and then converted to weighted average flow saturation of vehicle flow for the single lane (by dividing the weighted average flow data for the single lane by the maximum weighted average flow for a single lane). b) Vehicle speeds over a cross-section of a single lane is converted into a weighted average speed over the cross-section. c) Time occupancy ratios of a single lane is converted into a weighted average time occupancy ratio. d) For each type of the traffic parameters, the corresponding weighted factors are averaged to obtain the reliability of the type of the traffic parameters.

In an alternative solution of the embodiments of the present application, the processing unit includes:

a first processing module, configured for filtering the traffic data of the first target road section acquired by each of the traffic detection devices according to preset filter conditions respectively to obtain the filtered traffic data acquired by each of the traffic detection devices, wherein the filter conditions at least include any one or more of the following conditions: device parameters of the traffic detection devices, vehicle speed limits for different traffic conditions, vehicle flow limits for different types of roads, vehicle time occupancy rate, correlation between different types of traffic parameters.

A second processing module, configured for performing the time-space conversion and/or data conversion on the filtered traffic data acquired by each of the traffic detection devices to obtain the traffic parameters of the first target road section.

Specifically, the preset filter conditions for different traffic data can be different, erroneous data acquired by the traffic detection devices during traffic data acquisition are filtered out by filtering the traffic data, and time-space conversion and/or data conversion is performed on the filtered traffic data, which improves the accuracy of traffic road information analysis results.

In an alternative solution of the embodiments of the present application, the traffic data include at least any one or more of the following parameters: a vehicle time occupancy rate, flow saturation of vehicle flow, and a vehicle speed. The second processing module can include:

a first processing sub-module, configured for calculating the reliability of each type of parameters detected by each of the traffic detection devices within the first preset period based on detection accuracy of each of the traffic detection devices and the data amount of each type of the parameters actually acquired within the first preset period.

A second processing sub-module, configured for calculating weighted average of each type of the parameters actually acquired by using the reliability of each type of parameters as weighting factors to obtain the traffic parameters of the first target road section within the first preset period; and A third processing sub-module, configured for obtaining the reliability of the traffic parameters by averaging the reliability of a same type of parameters detected by each of the traffic detection devices.

Specifically, in the case that the detection period of any traffic detection device is less than or equal to the first preset period, the first preset period is determined according to the detection period. After calculating the reliability of each type of parameters detected by all traffic detection devices in each detection period, each type of parameters detected by all traffic detection devices in the first preset period is obtained by calculating the average value of the reliability of each type of parameters detected by all traffic detection devices in each detection period.

In an alternative solution of the embodiments of the present application, when the traffic data release period includes a plurality of time periods, each of which has a same duration as the first preset period, the apparatus can further include:

a second obtaining unit, configured for obtaining the reliability of real-time traffic conditions for the first target road section within each of the time periods of the traffic data release period.

Specifically, the traffic data release period can be preset, for example 5 minutes. When the duration of the first preset period is 1 minute, the traffic data release period can include five time periods with 1 minute duration. For the five time periods with a duration of 1 minute, the methods for processing the traffic parameters acquired for the first target road section within the time periods to obtain real-time traffic conditions for the first target road section within the time periods can be the same.

It should be noted that a weighting factor can be preset for each time period according to the correlation between each time period and traffic lights, and a smaller weighting factor can be preset when traffic lights change over the time period, which improves the accuracy of analysis results for road traffic conditions.

A first accumulation unit, configured for accumulating the reliability of traffic conditions of a same type within each of the time periods to obtain a accumulated reliability value for each type of traffic conditions.

A first selecting unit, configured for determining a traffic condition with the highest accumulated reliability value as the real-time traffic condition for the first target road section within the traffic data release period.

Specifically, the reliability of traffic condition of the same type are accumulated. For example, if the traffic data release period includes 5 time periods with 1 minute duration and the real-time traffic condition and confidence within each of the time periods are Unblocked (0.7), Slow (0.1), Slow (0.3), Congested (0.1) and Congested (0.1), the reliability of each type of traffic conditions obtained by accumulating the reliability of the same type of traffic conditions are: Unblocked (0.7), Slow (0.4), Congested (0.2). The real-time traffic condition of the first target road section within the traffic data release period is determined as the traffic condition "Unblocked" with the highest membership degree of "0.7".

It should be noted that it is possible for the analysis of traffic road information to avoid being influenced by the influence of the start/end of a red light and the start/end of a green light on the traffic by performing the above the second obtaining unit, the first accumulation unit and the first selecting unit in the embodiment of the present application.

In an alternative solution of the embodiments of the present application, the second obtaining unit can include:

a first calculation module, configured for calculating, for each of the time periods, the proportion of time in which the traffic on the first target road section is in a passing state.

A second calculation module, configured for calculating the reliability of the real-time traffic conditions for the first target section within each of the time periods based on the proportion of time in which the traffic is in the passing state and the reliability of the acquired traffic parameters of the first target road section within each of the time periods.

Specifically, the passing state of the traffic on the first target road section can be the state where vehicles proceed with the traffic lights on the first target road section displaying green light. That is, the traffic is in passing state when the traffic lights display green light, and the traffic is in stopped state when the traffic lights display red light. The stopped state and the congested traffic condition are different. The stopped state is a state where vehicles follow the traffic rules and are stopped when the traffic lights display red light. The congested traffic condition is a state where vehicles move slowly because of too many vehicles on a road section.

Optionally, the proportion X % of time can be calculated by the following first formula, $$X\ \% = \frac{t_1}{T},$$

wherein T is me duration of each time period, $t_1$ is the sum of the duration during which the traffic lights display green light within each time period.

Optionally, the proportion X % of time can also be calculated by the following second formula, $$X\ \% = \frac{T - t_2}{T},$$

wherein 1 is the duration of each time period, $t_2$ is the sum of the duration during which the traffic lights display red light within each time period.

It should be noted that the reliability of the real-time traffic condition on the first target road section can be calculated from the proportion of time and the reliability of the traffic parameters of this road section. The real-time traffic conditions obtained from analysis can be evaluated directly by calculating the reliability of real-time traffic conditions. The higher the confidence, the more accurate the analysis results of the real-time traffic conditions can be.

In an alternative solution of the embodiments of the present application, when a second target road section includes a plurality of spatially discontinuous road sections including the first target road section, the apparatus can further include:

a third obtaining unit, configured for reading a plurality of road section weighting factors corresponding to the plurality of road sections.

Specifically, in an optional solution provided in the embodiments, a weighting factor can be provided for a road section to improve the accuracy of the analysis results of the traffic condition. A road section weighting factor is preset for each road section in the second target road section. For a road section close to an intersection of the traffic road, traffic lights will have a great impact on the traffic parameters, thus a smaller weighting factor can be set for such road section. A larger weighting factor can be set for a section far away from an intersection in the traffic road. These improves the accuracy of the analysis of traffic conditions.

A calculation unit, configured for calculating the product of the weighting factor for of the plurality of road sections and the reliability of the real-time traffic condition for the corresponding road section within the traffic data release period.

A second accumulation unit, configured for accumulating the products of all road sections having a same type of traffic conditions to obtain a accumulated value for each type of traffic conditions.

A second selecting unit, configured for determining a traffic condition with the highest accumulated value as the real-time traffic condition for the second target road section within the traffic data release period.

Specifically, the product of the weight for any road section and the reliability of the real-time traffic corresponding to this road section is calculated. The products then are added up according to the type of the traffic conditions. The real-time traffic condition of the second target road section within the traffic data release period is determined as the traffic condition with the highest accumulated value.

In an alternative solution of the embodiments of the present application, when the traffic data release period includes a plurality of time periods, each of which has a same duration as the first preset period, the apparatus can further include:

A fourth obtaining unit, configured for reading a priority for each type of traffic conditions.

Specifically, the priority for each type of traffic conditions can be preset, for example, the priority can include a high priority, a medium priority and a low priority.

A third selecting unit, configured for determining a traffic condition with a high priority among the real-time traffic conditions for the first target road section within each of the time periods as the real-time traffic condition for the first target road section within the traffic data release period.

Specifically, for example, Unblocked is provided with a high priority, Congested is provided with a low priority, and Slow is provided with a medium priority. Among a plurality of time periods of the traffic data release period, if the real-time traffic conditions in a time period includes Unblocked, the real-time traffic condition for the first target road section within the traffic data release period is determined as being Unblocked; if the real-time traffic conditions in a time period includes a Slow and Congested, the real-time traffic condition for the first target road section within the traffic data release period is determined as being Slow; and if the traffic within the plurality of the time period are all Congested, the real-time traffic condition for the first target road section within the traffic data release period is determined as being Congested. In the embodiments of the present application, the fourth obtaining unit and the third selecting unit solve the problem that there are errors in the traffic condition analysis results caused by the traffic signal lights when processing the traffic road information is solved.

In an alternative solution of the embodiments of the present application, the determining unit can include:

a first determining module, configured for determining the membership degrees for the traffic parameters in the fuzzy rule matrix table by calling a membership function.

Specifically, the first determining module can include a first reading sub-module, a first processing sub-module and a storage module.

The first reading sub-module is configured for obtaining lower thresholds and upper thresholds corresponding to the traffic parameters from a preset traffic parameter threshold table, and determining the membership function for traffic parameters in different scenarios based on the lower thresholds and upper thresholds.

Specifically, the traffic parameter threshold table can be preset, such as shown in Table I. In an implementation of the present application, in order to improve the accuracy of traffic road information analysis results, different upper and lower thresholds can be preset for different types of traffic roads. As can be seen from Table I, in the road information analysis, when the traffic parameter is the vehicle speed, the lower threshold for the speed on a primary main road can be 12 km/h and the upper threshold can be 25 km/h, and the lower threshold for the speed on an expressway can be 20 km/h and the upper threshold can be 45 km/h.

TABLE I

| | vehicle speed (km/h) | flow saturation of vehicle flow | vehicle time occupancy rate | average headway time (s) |
|---|---|---|---|---|
| expressway | 20-45 | 0.3-0.6 | 50%-75% | 0.5-1.5 |
| primary main road | 12-25 | 0.25-0.5 | 50%-75% | 0.5-1.5 |
| secondary main road | 10-23 | 0.2-0.4 | 50%-75% | 0.5-1.5 |
| access road | 8-20 | 0.15-0.3 | 50%-75% | 0.5-1.5 |

It should be noted that the membership function of the vehicle speed can be as shown in FIG. 2 when the traffic parameter is the vehicle speed and the scenarios include the first type of scenario, the second type of scenario and the third type scenario. In FIG. 2, the lower threshold of the vehicle speed is 20 km/h; the upper threshold of the vehicle speed is 45 km/h; and the membership function of the vehicle speed in the first type of scenario, the second type of scenario and the third type scenario are shown in FIG. 2.

The first processing sub-module is configured for obtaining the membership degree of a traffic parameter in different scenarios by applying the corresponding function to the traffic parameter respectively.

Specifically, according to the membership function of the vehicle speed in FIG. 2, if the vehicle speed of an expressway is 50 km/h, the corresponding membership degree in the first type of scenario can be 0, the corresponding membership degree in the second type of scenario can be 0, and the corresponding membership degree in the third type of scenario can be 1.

The storage module is configured for saving the membership degrees of the traffic parameter in different scenarios to a fuzzy rule matrix table, wherein the fuzzy rule matrix table contains a plurality of units, and the membership degrees of the traffic parameter in different scenarios are saved to different units respectively.

Specifically, for example, the different scenarios include the first type of scenario, the second type of scenario and the third type of scenario, the vehicle speed of an expressway is 50 km/h, and the vehicle time occupancy rate is 50%, the membership degrees of the traffic parameter are saved to different units in the fuzzy rule matrix table according to the corresponding membership function, as shown in table II.

TABLE II

| membership degree | the first type of scenario | the second type of scenario | the third type of scenario |
|---|---|---|---|
| vehicle speed (50 km/h) | 0 | 0 | 1 |
| vehicle time occupancy rate (50%) | 1 | 0 | 0 |

| | vehicle time occupancy rate | | |
|---|---|---|---|
| vehicle speed | the first type of scenario | the second type of scenario | the third type of scenario |

TABLE II-continued

| | | | |
|---|---|---|---|
| the first type of scenario | slow (0, 1) | congested (0, 0) | congested (0, 0) |
| the second type of scenario | unblocked (0, 1) | slow (0, 0) | congested (0, 0) |
| the third type of scenario | unblocked (1, 1) | unblocked (1, 0) | slow (1, 0) |

In an optional scenario, the first processing sub-module can be configured for, when the traffic parameter is less than the lower threshold, determining the membership degree of the traffic parameter to the first type of scenario as 1, the membership of the traffic parameter to the second type of scenario as 0, and the membership of the traffic parameter to the third type of scenario as 0. When the traffic parameter is greater than the lower threshold and less than the midpoint threshold, the membership of the traffic parameter to the first type of scenario is determined according to a first calculation model, the membership of the traffic parameter to the second type of scenario is determined according to a second calculation model, the membership of the traffic parameter to the third type of scenario is determined as 0, wherein the midpoint threshold is the average of the lower threshold and the upper threshold. When the traffic parameter is greater than the midpoint threshold and less than the upper threshold, the membership of the traffic parameter to the first type of scenario is determined as 0, the membership of the traffic parameter to the second type of scenario is determined according to a third calculation model, the membership of the traffic parameter to the third type of scenario is determined according to a fourth calculation model. When the traffic parameter is greater than the upper threshold, determining the membership degree of the traffic parameter to the first type of scenario as 0, the membership of the traffic parameter to the second type of scenario as 0, and the membership of the traffic parameter to the third type of scenario as 1. The midpoint threshold can be the average of the lower and upper thresholds for the traffic parameter. Optionally, the midpoint threshold can also be set according to the actual situations, and can be any preset threshold that can be used for properly handling traffic road information.

In an alternative solution of the embodiments of the present application, the second processing sub-module calculates the membership degree of a traffic parameter to the first type of scenario according to the first calculation model $f_1$:

$$f_1 = \frac{a+b-2x}{b-a},$$

wherein a is the lower threshold, b is the upper threshold, and x is the value of the traffic parameter; the membership degree of a traffic parameter to the second type of scenario is calculated according to the second calculation model $f_2$:

$$f_2 = \frac{2x-2a}{b-a},$$

wherein a is the lower threshold, b is the upper threshold, and x is the value of the traffic parameter; the membership degree of a traffic parameter to the second type of scenario is calculated according to the third calculation model $f_3$:

$$f_3 = \frac{2b-2x}{b-a},$$

wherein a is the lower threshold, b is the upper threshold, and x is the value of the traffic parameter; and the membership degree of a traffic parameter to the third type of scenario is calculated according to the fourth calculation model $f_4$:

$$f_4 = \frac{2x-a-b}{b-a},$$

wherein a is the lower threshold, b is the upper threshold, and x is the value of the traffic parameter.

Specifically, an equivalent replacement approach to calculate the membership degree of a traffic parameter in different scenarios in the value range can be:

(1) The First Type of Scenario

If $0 \le x < a$, the membership degree of the traffic parameter to the first type of scenario is determined as 1; if $$a < x \le \frac{a+b}{2},$$

the membership of the traffic parameter to the first type of scenario is determined as $$f_1 = \frac{a+b-2x}{b-a};$$

and if $$x > \frac{a+b}{2},$$

the membership of the traffic parameter to the first type of scenario is determined as 0.

(2) The Second Type of Scenario

If $0 \le x < a$, the membership degree of the traffic parameter to the second type of scenario is determined as 0; if $$a < x \le \frac{a+b}{2},$$

the membership of the traffic parameter to the second type of scenario is determined as $$f_2 = \frac{2x-2a}{b-a};$$

if $$\frac{a+b}{2} < x \le b,$$

the membership of the traffic parameter to the second type of scenario is determined as $$f_3 = \frac{2b - 2x}{b - a};$$

and if x>b, the membership of the traffic parameter to the second type of scenario is determined as 0.

(3) The Third Type of Scenario

If $$0 \le x < \frac{a+b}{2},$$

the membership degree of the traffic parameter to the third type of scenario is determined as 0; if $$\frac{a+b}{2} < x \le b,$$

the membership of the traffic parameter to the third type of scenario is determined as $$f_4 = \frac{2x - a - b}{b - a};$$

and if x>b, the membership of the traffic parameter to the third type of scenario is determined as 1.

The second determining module is configured for determining the membership degree of each type of traffic conditions contained in the fuzzy rule matrix table based on the membership degrees of the traffic parameters in the fuzzy rule matrix table.

The second determining module can include a second reading sub-module, a second processing sub-module, an aggregation module, and a comparing sub-module.

The second reading module is configured for obtaining the membership degrees of a traffic parameter in the fuzzy rule matrix table.

The second processing module is configured for processing the membership degrees of the traffic parameter in different scenarios contained in each of units according to a first preset rule to obtain a preset membership degree for the traffic condition in the unit.

Specifically, the first preset rule can be: when the fuzzy rule matrix table is a one-dimensional fuzzy rule matrix table, the membership degree of the traffic parameter contained in each of the units in the fuzzy rule matrix table is determined as the preset membership degree for the traffic condition in the unit; when the fuzzy rule matrix table is a multi-dimensional fuzzy rule matrix table, the minimum membership degree of the traffic parameter contained in each of the units is determined as the preset membership degree for the traffic condition in the unit. For example, in Table II, the two-dimensional fuzzy rule matrix table on vehicle speeds/vehicle occupancy, the membership degrees of the traffic parameters in different scenarios contained in each of the units in Table 2 are processed according to the above first preset rule to obtain the preset membership degree for the traffic condition in the unit in the fuzzy rule matrix table, such as shown in Table III.

TABLE III

| | vehicle time occupancy rate | | |
|---|---|---|---|
| vehicle speed | the first type of scenario | the second type of scenario | the third type of scenario |
| the first type of scenario | slow (0) | congested (0) | congested (0) |
| the second type of scenario | unblocked (0) | slow (0) | congested (0) |
| the third type of scenario | unblocked (1) | unblocked (0) | slow (0) |

The aggregation sub-module is configured for aggregating the membership degree in each of the units in the fuzzy rule matrix table for each type of traffic conditions to obtain the aggregation result of the membership degrees for each type of traffic conditions.

Specifically, in a one-dimensional or multi-dimensional fuzzy rule matrix table, there are a plurality of membership degrees for one type of traffic conditions in the units of the fuzzy rule matrix table. The aggregation result of the membership degrees for a same type of traffic conditions can be obtained by aggregating the membership degrees of the type of traffic condition. For example, as shown in Table III, there are three membership degrees for Unblocked, which are unblocked (0), unblocked (0) and Unblocked (1). The aggregation result Unblocked (1) can be obtained by aggregating the above three membership degrees.

It should be noted that aggregation performed on a same type of traffic conditions can be that the maximum membership degree for the same type of traffic conditions is determined as the membership degree for this traffic condition. For example, the aggregation result obtained by performing aggregation on Table III can be shown as Table IV.

TABLE IV

| traffic condition | membership degree |
|---|---|
| unblocked | 1 |
| slow | 0 |
| congested | 0 |

The comparing module is configured for comparing the membership degrees of each type of traffic condition, and determining a traffic condition with the maximum membership degree as the real-time traffic condition for the first target road section within the first preset period.

Specifically, taking the membership degrees for each type of traffic conditions in Table IV as an example, it is determined by the comparing sub-module that the maximum membership degree in the membership degrees of the three types of traffic condition is 1, and the type of the traffic condition corresponding to the membership degree is Unblocked.

It should be noted that when there are two or more maximum membership degrees, the relatively unobstructed traffic condition can be selected as the real-time traffic condition for the first target road section within the first preset period. For example, the relatively unobstructed traffic condition can be selected as follows: if the values of the membership degree for Unblocked and for Slow are the same, Unblocked is selected as the real-time traffic condition for the first target road section within the first preset period.

In an alternative solution of the embodiments of the present application, the apparatus can further include:

a recording unit, configured for determining the reliability of the real-time traffic condition of the second target road section within the traffic data release period as the accumulated value of the calculation result for the traffic conditions.

Specifically, the embodiments of the present application provides, taking Table II as an example, a method for obtaining traffic road information by traffic parameter analysis in a case where the traffic parameters are the vehicle speed and vehicle occupancy. For traffic parameters including one parameter, two parameters but different from the case including vehicle speed and vehicle occupancy, or three parameters, the analysis process is the same as the analysis process including the vehicle speed and vehicle occupancy in this embodiment, and a one-dimensional fuzzy rule matrix table, a two-dimensional fuzzy rule matrix table, or a three-dimensional fuzzy rule matrix table can be used. The two-dimensional fuzzy rule matrix table and three-dimensional fuzzy rule matrix table can be formulated referring to the flow-density curve shown in FIG. 3*a* and FIG. 3*b*. In FIG. 3*a* and FIG. 3*b*, the speed can be the vehicle speed in the embodiment of the present application, the flow can be the number of vehicles passing in a unit interval, and the density can be the number of vehicles in a unit distance. In FIG. 3*a*, Q=V·K, wherein Q denotes flow, K denotes density, and V denotes speed. In FIG. 3*b*, $$\tan\theta = \frac{Q_m}{K_m} = V_m,$$

the graph of Q-K, V-Q and V-K relationship can be obtained in FIG. 3*b*.

The embodiments of the present application further provide a terminal, including:

a processor, a memory, communication interfaces, and a bus.

The processor, the memory and the communication interfaces are connected and communicate with each other via the bus.

The memory stores executable program code;

The processor runs a program corresponding to the executable program code by reading the executable program code stored in the memory for:

obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed;

selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table;

determining a membership degree for each type of traffic conditions contained in the first fuzzy rule matrix table by calling a membership function, wherein the traffic conditions at least include the following types: Unblocked, Slow and Congested;

comparing the membership degrees of all types of traffic conditions contained in the first fuzzy rule matrix table to determine the real-time traffic condition for the first target road section within the first preset period.

Optionally, in a case where there are at least two traffic parameters of the first target road section, the reliability of the traffic parameters of the first target road section is a combination of the reliability of each of the parameters, wherein selecting a first fuzzy rule matrix table from a pre-stored set of fuzzy rule matrix tables based on the number of the traffic parameters of the first target road section and/or the reliability of the traffic parameters includes:

obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters;

selecting a fuzzy rule matrix table that matches with the reliability of the traffic parameters of the first target road section from the group of fuzzy rule matrix tables to obtain the first fuzzy rule matrix table.

Optionally, before obtaining acquired traffic parameters of a first target road section and/or the reliability of the traffic parameters within a first preset period, the method further includes:

acquiring traffic data of the first target road section by using a plurality of traffic detection devices within the first preset period, wherein the plurality of traffic devices at least include a combination of any number of the following devices: a magnetic frequency vehicle detector, a wave frequency vehicle detector, a video vehicle detector, a coil vehicle detector, a microwave vehicle detector, a geomagnetic vehicle detector and a SCATS vehicle detector;

preprocessing the traffic data to obtain traffic parameters of the first target road section, wherein the data preprocessing includes at least any one or more of the following processings: filtering of the traffic data, time-space conversion of the traffic data, and data conversion of the traffic data.

Optionally, preprocessing the traffic data to obtain traffic parameters of the first target road section includes:

filtering the traffic data of the first target road section acquired by each of the traffic detection devices according to preset filter conditions respectively to obtain the filtered traffic data acquired by each of the traffic detection devices, wherein the filter conditions at least include any one or more of the following conditions: device parameters of the traffic detection devices, vehicle speed limits for different traffic conditions, vehicle flow limits for different types of roads, vehicle time occupancy rate, correlation between different types of traffic parameters;

performing the time-space conversion and/or data conversion on the filtered traffic data acquired by each of the traffic detection devices to obtain the traffic parameters of the first target road section.

The traffic parameters include at least any one or more types of the following parameters: a vehicle time occupancy rate, flow saturation of vehicle flow, and a vehicle speed, wherein performing the data conversion on the filtered traffic data acquired by each of the traffic detection devices to obtain the traffic parameters of the first target road section includes:

calculating the reliability of each type of parameters detected by each of the traffic detection devices within the first preset period based on detection accuracy of each of the traffic detection devices and the data amount of each type of the parameters actually acquired within the first preset period;

calculating weighted average of each type of the parameters actually acquired by using the reliability of each type of parameters as weighting factors to obtain the traffic parameters of the first target road section within the first preset period;

wherein the reliability of the traffic parameters is obtained by averaging the reliability of a same type of parameters detected by each of the traffic detection devices.

Optionally, when the traffic data release period includes a plurality of time periods, each of which has a same duration as the first preset period, after comparing the membership degrees of all types of traffic conditions contained in the first fuzzy rule matrix table to determine the real-time traffic condition for the first target road section within the first preset period, the method further includes:

obtaining the reliability of real-time traffic conditions for the first target road section within each of the time periods of the traffic data release period;

accumulating the reliability of traffic conditions of a same type within each of the time periods to obtain a accumulated reliability value for each type of traffic conditions;

determining a traffic condition with the highest accumulated reliability value as the real-time traffic condition for the first target road section within the traffic data release period.

Optionally, obtaining the reliability of real-time traffic conditions for the first target road section within each of the time periods of the traffic data release period, includes:

calculating, for each of the time periods, the proportion of time in which the traffic on the first target road section is in a passing state;

calculating the reliability of the real-time traffic conditions for the first target section within each of the time periods based on the proportion of time in which the traffic is in the passing state and the reliability of the acquired traffic parameters of the first target road section within each of the time periods.

Optionally, when a second target road section includes a plurality of spatially discontinuous road sections including the first target road section, wherein after determining a traffic condition with the highest accumulated reliability value as the real-time traffic condition for the first target road section within the traffic data release period, the method further includes:

reading a plurality of road section weighting factors corresponding to the plurality of road sections;

calculating the product of the weighting factor for of the plurality of road sections and the reliability of the real-time traffic condition for a corresponding road section within the traffic data release period;

accumulating the products of the road sections with a same type of traffic conditions to obtain a accumulated value for each type of traffic conditions;

determining a traffic condition with the highest accumulated value as the real-time traffic condition for the second target road section within the traffic data release period.

Optionally, when the traffic data release period includes a plurality of time periods, each of which has a same duration as the first preset period, after comparing the membership degrees of all types of traffic conditions contained in the first fuzzy rule matrix table to determine the real-time traffic condition for the first target road section within the first preset period, the method further includes:

reading a priority for each type of traffic conditions;

determining a traffic condition with a high priority among the real-time traffic conditions for the first target road section within each of the time periods as the real-time traffic condition for the first target road section within the traffic data release period.

Optionally, determining a membership degree for each type of traffic conditions contained in the first fuzzy rule matrix table by calling a membership function, includes:

determining the membership degrees for the traffic parameters in the fuzzy rule matrix table by calling a membership function;

determining the membership degree of each type of traffic conditions contained in the fuzzy rule matrix based on the membership degrees of the traffic parameters in the fuzzy rule matrix table.

The embodiments of the present application further provide an application, which is executed to perform the method for processing traffic road information provided by the embodiments of the present application. The method for processing traffic road information includes:

obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed;

selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table;

determining a membership degree for each type of traffic conditions contained in the first fuzzy rule matrix table by calling a membership function, wherein the traffic conditions at least include the following types: Unblocked, Slow and Congested;

comparing the membership degrees of all types of traffic conditions contained in the first fuzzy rule matrix table to determine the real-time traffic condition for the first target road section within the first preset period.

Optionally, in a case where there are at least two traffic parameters of the first target road section, the reliability of the traffic parameters of the first target road section is a combination of the reliability of each of the parameters, wherein selecting a first fuzzy rule matrix table from a pre-stored set of fuzzy rule matrix tables based on the number of the traffic parameters of the first target road section and/or the reliability of the traffic parameters includes:

obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters;

selecting a fuzzy rule matrix table that matches with the reliability of the traffic parameters of the first target road section from the group of fuzzy rule matrix tables to obtain the first fuzzy rule matrix table.

Optionally, before obtaining acquired traffic parameters of a first target road section and/or the reliability of the traffic parameters within a first preset period, the method further includes:

acquiring traffic data of the first target road section by using a plurality of traffic detection devices within the first preset period, wherein the plurality of traffic devices at least include a combination of any number of the following devices: a magnetic frequency vehicle detector, a wave frequency vehicle detector, a video vehicle detector, a coil vehicle detector, a microwave vehicle detector, a geomagnetic vehicle detector and a SCATS vehicle detector;

preprocessing the traffic data to obtain traffic parameters of the first target road section, wherein the data preprocessing includes at least any one or more of the following processings: filtering of the traffic data, time-space conversion of the traffic data, and data conversion of the traffic data.

Optionally, preprocessing the traffic data to obtain traffic parameters of the first target road section includes:

filtering the traffic data of the first target road section acquired by each of the traffic detection devices according to preset filter conditions respectively to obtain the filtered traffic data acquired by each of the traffic detection devices, wherein the filter conditions at least include any one or more of the following conditions: device parameters of the traffic detection devices, vehicle speed limits for different traffic conditions, vehicle flow limits for different types of roads, vehicle time occupancy rate, correlation between different types of traffic parameters;

performing the time-space conversion and/or data conversion on the filtered traffic data acquired by each of the traffic detection devices to obtain the traffic parameters of the first target road section.

The traffic parameters include at least any one or more types of the following parameters: a vehicle time occupancy rate, flow saturation of vehicle flow, and a vehicle speed, wherein performing the data conversion on the filtered traffic data acquired by each of the traffic detection devices to obtain the traffic parameters of the first target road section includes:

calculating the reliability of each type of parameters detected by each of the traffic detection devices within the first preset period based on detection accuracy of each of the traffic detection devices and the data amount of each type of the parameters actually acquired within the first preset period;

calculating weighted average of each type of the parameters actually acquired by using the reliability of each type of parameters as weighting factors to obtain the traffic parameters of the first target road section within the first preset period;

wherein the reliability of the traffic parameters is obtained by averaging the reliability of a same type of parameters detected by each of the traffic detection devices.

Optionally, when the traffic data release period includes a plurality of time periods, each of which has a same duration as the first preset period, after comparing the membership degrees of all types of traffic conditions contained in the first fuzzy rule matrix table to determine the real-time traffic condition for the first target road section within the first preset period, the method further includes:

obtaining the reliability of real-time traffic conditions for the first target road section within each of the time periods of the traffic data release period;

accumulating the reliability of traffic conditions of a same type within each of the time periods to obtain a accumulated reliability value for each type of traffic conditions;

determining a traffic condition with the highest accumulated reliability value as the real-time traffic condition for the first target road section within the traffic data release period.

Optionally, obtaining the reliability of real-time traffic conditions for the first target road section within each of the time periods of the traffic data release period, includes:

calculating, for each of the time periods, the proportion of time in which the traffic on the first target road section is in a passing state;

calculating the reliability of the real-time traffic conditions for the first target section within each of the time periods based on the proportion of time in which the traffic is in the passing state and the reliability of the acquired traffic parameters of the first target road section within each of the time periods.

Optionally, when a second target road section includes a plurality of spatially discontinuous road sections including the first target road section, wherein after determining a traffic condition with the highest accumulated reliability value as the real-time traffic condition for the first target road section within the traffic data release period, the method further includes:

reading a plurality of road section weighting factors corresponding to the plurality of road sections;

calculating the product of the weighting factor for of the plurality of road sections and the reliability of the real-time traffic condition for the corresponding road section within the traffic data release period;

accumulating the products of all road sections having a same type of traffic conditions to obtain a accumulated value for each type of traffic conditions;

determining a traffic condition with the highest accumulated value as the real-time traffic condition for the second target road section within the traffic data release period.

Optionally, when the traffic data release period includes a plurality of time periods, each of which has a same duration as the first preset period, after comparing the membership degrees of all types of traffic conditions contained in the first fuzzy rule matrix table to determine the real-time traffic condition for the first target road section within the first preset period, the method further includes:

reading a priority for each type of traffic conditions;

determining a traffic condition with a high priority among the real-time traffic conditions for the first target road section within each of the time periods as the real-time traffic condition for the first target road section within the traffic data release period.

Optionally, determining a membership degree for each type of traffic conditions contained in the first fuzzy rule matrix table by calling a membership function, includes:

determining the membership degrees for the traffic parameters in the fuzzy rule matrix table by calling a membership function;

determining the membership degree of each type of traffic conditions contained in the fuzzy rule matrix based on the membership degrees of the traffic parameters in the fuzzy rule matrix table.

The embodiments of the present application further provide a storage medium for storing application program, which is executed to perform the method for processing traffic road information provided by the embodiments of the present application. The method for processing traffic road information includes:

obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed;

selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table;

determining a membership degree for each type of traffic conditions contained in the first fuzzy rule matrix table by calling a membership function, wherein the traffic conditions at least include the following types: Unblocked, Slow and Congested;

comparing the membership degrees of all types of traffic conditions contained in the first fuzzy rule matrix table to determine the real-time traffic condition for the first target road section within the first preset period.

Optionally, in a case where there are at least two traffic parameters of the first target road section, the reliability of the traffic parameters of the first target road section is a combination of the reliability of each of the parameters, wherein selecting a first fuzzy rule matrix table from a pre-stored set of fuzzy rule matrix tables based on the number of the traffic parameters of the first target road section and/or the reliability of the traffic parameters includes:

obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters;

selecting a fuzzy rule matrix table that matches with the reliability of the traffic parameters of the first target road section from the group of fuzzy rule matrix tables to obtain the first fuzzy rule matrix table.

Optionally, before obtaining acquired traffic parameters of a first target road section and/or the reliability of the traffic parameters within a first preset period, the method further includes:

acquiring traffic data of the first target road section by using a plurality of traffic detection devices within the first preset period, wherein the plurality of traffic devices at least include a combination of any number of the following devices: a magnetic frequency vehicle detector, a wave frequency vehicle detector, a video vehicle detector, a coil vehicle detector, a microwave vehicle detector, a geomagnetic vehicle detector and a SCATS vehicle detector;

preprocessing the traffic data to obtain traffic parameters of the first target road section, wherein the data preprocessing includes at least any one or more of the following processings: filtering of the traffic data, time-space conversion of the traffic data, and data conversion of the traffic data.

Optionally, preprocessing the traffic data to obtain traffic parameters of the first target road section includes:

filtering the traffic data of the first target road section acquired by each of the traffic detection devices according to preset filter conditions respectively to obtain the filtered traffic data acquired by each of the traffic detection devices, wherein the filter conditions at least include any one or more of the following conditions: device parameters of the traffic detection devices, vehicle speed limits for different traffic conditions, vehicle flow limits for different types of roads, vehicle time occupancy rate, correlation between different types of traffic parameters;

performing the time-space conversion and/or data conversion on the filtered traffic data acquired by each of the traffic detection devices to obtain the traffic parameters of the first target road section.

the traffic parameters include at least any one or more types of the following parameters: a vehicle time occupancy rate, flow saturation of vehicle flow, and a vehicle speed, wherein performing the data conversion on the filtered traffic data acquired by each of the traffic detection devices to obtain the traffic parameters of the first target road section includes:

calculating the reliability of each type of parameters detected by each of the traffic detection devices within the first preset period based on detection accuracy of each of the traffic detection devices and the data amount of each type of the parameters actually acquired within the first preset period;

calculating weighted average of each type of the parameters actually acquired by using the reliability of each type of parameters as weighting factors to obtain the traffic parameters of the first target road section within the first preset period;

wherein the reliability of the traffic parameters is obtained by averaging the reliability of a same type of parameters detected by each of the traffic detection devices.

Optionally, when the traffic data release period includes a plurality of time periods, each of which has a same duration as the first preset period, after comparing the membership degrees of all types of traffic conditions contained in the first fuzzy rule matrix table to determine the real-time traffic condition for the first target road section within the first preset period, the method further includes:

obtaining the reliability of real-time traffic conditions for the first target road section within each of the time periods of the traffic data release period;

accumulating the reliability of traffic conditions of a same type within each of the time periods to obtain a accumulated reliability value for each type of traffic conditions;

determining a traffic condition with the highest accumulated reliability value as the real-time traffic condition for the first target road section within the traffic data release period.

Optionally, obtaining the reliability of real-time traffic conditions for the first target road section within each of the time periods of the traffic data release period, includes:

calculating, for each of the time periods, the proportion of time in which the traffic on the first target road section is in a passing state;

calculating the reliability of the real-time traffic conditions for the first target section within each of the time periods based on the proportion of time in which the traffic is in the passing state and the reliability of the acquired traffic parameters of the first target road section within each of the time periods.

Optionally, when a second target road section includes a plurality of spatially discontinuous road sections including the first target road section, wherein after determining a traffic condition with the highest accumulated reliability value as the real-time traffic condition for the first target road section within the traffic data release period, the method further includes:

reading a plurality of road section weighting factors corresponding to the plurality of road sections;

calculating the product of the weighting factor for of the plurality of road sections and the reliability of the real-time traffic condition for the corresponding road section within the traffic data release period;

accumulating the products of all road sections having a same type of traffic conditions to obtain a accumulated value for each type of traffic conditions;

determining a traffic condition with the highest accumulated value as the real-time traffic condition for the second target road section within the traffic data release period.

Optionally, when the traffic data release period includes a plurality of time periods, each of which has a same duration as the first preset period, after comparing the membership degrees of all types of traffic conditions contained in the first fuzzy rule matrix table to determine the real-time traffic condition for the first target road section within the first preset period, the method further includes:

reading a priority for each type of traffic conditions;

determining a traffic condition with a high priority among the real-time traffic conditions for the first target road section within each of the time periods as the real-time traffic condition for the first target road section within the traffic data release period.

Optionally, determining a membership degree for each type of traffic conditions contained in the first fuzzy rule matrix table by calling a membership function, includes:

determining the membership degrees for the traffic parameters in the fuzzy rule matrix table by calling a membership function;

determining the membership degree of each type of traffic conditions contained in the fuzzy rule matrix based on the membership degrees of the traffic parameters in the fuzzy rule matrix table.

The serial numbers of the above embodiments of the present application are merely for description and do not indicate that one embodiment is better than another.

For the description of each of the embodiments of the present application, the emphasis is laid on a particular aspect. For the parts that are not described in detail in a certain embodiment, references can be made to the corresponding description of other embodiments.

It should be understood that in the embodiments herein, the disclosed technical solution can be implemented in other ways. The apparatus embodiments described above are merely illustrative. For example, the apparatus can be divided into units according to the logical functions, however, in practice, the apparatus can be divided in other ways. For example, a plurality of units or components can be combined or integrated into another system, or some features can be omitted or not be executed. Further, units or modules shown or discussed above can be coupled or directly coupled or communicatively connected to each other via interfaces, and the units or modules can be indirectly connected or communicatively connected electrically or in other ways.

The units illustrated as separate components may or may not be physically separated. The components shown as units may or may not be physical units, and can be located on one unit or can be distributed on a plurality of units. Some or all of the units can be selected according to actual needs to achieve the objective of the solution of the present embodiments.

In addition, all the function units in the embodiments of the present application can be integrated in one processing unit, or each of the units can be an individual unit, or two or more units can be integrated in one unit. The integrated unit described above can be implemented as hardware or can be implemented as a software function unit.

If the integrated unit is implemented as a software function unit and is sold or used as an independent product, the integrated unit can be stored in a computer readable storage medium. On the basis of the understanding above, the essential technical solution of the present application, or the part contributing to the prior art, or all or a part of the technical solution can be implemented as a software product. The computer software product is stored in a storage medium, including instructions to make a computer device (such as, a personal computer, a server or network equipment) perform all or some of the steps in the method of each embodiment of the present application. The storage medium includes medium capable of storing program code, such as a USB flash disk, a Read Only Memory (ROM), a Random Access Memory (RAM), a mobile hard disk, a magnetic disk, or an optical disk.

The implementations are merely preferred implementations of the present application. It should be noted that those of ordinary skills in the art can make improvements and modifications without departing from the principle of the present application, and these improvements and modifications should be considered within the protection scope of the present application. Preferred embodiments are described in the following:

A method for processing traffic road information includes: obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed; selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table; determining a membership degree for each type of traffic conditions contained in the first fuzzy rule matrix table by calling a membership function, wherein the traffic conditions at least include the following types: Unblocked, Slow and Congested; and comparing the membership degrees of all types of traffic conditions contained in the first fuzzy rule matrix table to determine a real-time traffic condition for the first target road section within the first preset period.

In the case that there are at least two traffic parameters of the first target road section, the reliability of the traffic parameters of the first target road section is a combination of the reliability of each of the parameters, wherein selecting a first fuzzy rule matrix table from a pre-stored set of fuzzy rule matrix tables based on the number of the traffic parameters of the first target road section and/or the reliability of the traffic parameters includes: obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters; and selecting a fuzzy rule matrix table that matches with the reliability of the traffic parameters of the first target road section from the group of fuzzy rule matrix tables to obtain the first fuzzy rule matrix table.

Before obtaining acquired traffic parameters of a first target road section and/or the reliability of the traffic parameters within a first preset period, the method further includes: acquiring traffic data of the first target road section by using a plurality of traffic detection devices within the first preset period, wherein the plurality of traffic devices at least include a combination of any of the following devices: a magnetic frequency vehicle detector, a wave frequency vehicle detector, a video vehicle detector, a coil vehicle detector, a microwave vehicle detector, a geomagnetic vehicle detector and a SCATS vehicle detector; preprocessing the traffic data to obtain traffic parameters of the first target road section, wherein the preprocessing includes at least one or more of the following processings: filtering of the traffic data, time-space conversion of the traffic data, and data conversion of the traffic data.

The preprocessing the traffic data to obtain traffic parameters of the first target road section includes: filtering the traffic data of the first target road section acquired by each of the traffic detection devices respectively according to preset filter conditions to obtain the filtered traffic data acquired by each of the traffic detection devices, wherein the filter conditions at least include one or more of the following conditions: device parameters of the traffic detection devices, vehicle speed limits for different traffic conditions, vehicle flow limits for different types of roads, the vehicle time occupancy rate, correlations between different types of traffic parameters; performing the time-space conversion and/or data conversion on the filtered traffic data acquired by each of the traffic detection devices to obtain the traffic parameters of the first target road section.

The traffic data at least include one or more types of the following parameters: a vehicle time occupancy rate, flow saturation of vehicle flow, and a vehicle speed, wherein performing the data conversion on the filtered traffic data acquired by each of the traffic detection devices to obtain the traffic parameters of the first target road section includes: calculating the reliability of each type of parameters detected by each of the traffic detection devices within the first preset period based on detection accuracy of each of the traffic detection devices and the data amount of each type of the parameters actually acquired within the first preset period; and calculating weighted average of each type of the parameters actually acquired by using the reliability of each type of parameters as weighting factors to obtain the traffic parameters of the first target road section within the first preset period; wherein the reliability of the traffic parameters is obtained by averaging the reliability of a same type of parameters detected by each of the traffic detection devices.

In the case that a traffic data release period includes a plurality of time periods, each of which has a same duration as the first preset period, after comparing the membership degrees of all types of traffic conditions contained in the first fuzzy rule matrix table to determine a real-time traffic condition for the first target road section within the first preset period, the method further includes: obtaining the reliability of real-time traffic conditions for the first target road section within each of the time periods of the traffic data release period; accumulating the reliability of traffic conditions of a same type within each of the time periods to obtain a accumulated reliability value for each type of traffic conditions; determining a traffic condition with the highest accumulated reliability value as the real-time traffic condition for the first target road section within the traffic data release period.

The obtaining the reliability of real-time traffic conditions for the first target road section within each of the time periods of the traffic data release period includes: calculating, for each of the time periods, a proportion of time in which the traffic on the first target road section is in a passing state; calculating the reliability of the real-time traffic conditions for the first target section within each of the time periods based on the proportion of time in which the traffic is in the passing state and the reliability of the acquired traffic parameters of the first target road section within each of the time periods.

In the case that a second target road section includes a plurality of spatially discontinuous road sections including the first target road section, wherein after determining a traffic condition with the highest accumulated reliability value as the real-time traffic condition for the first target road section within the traffic data release period, the method further includes: reading a plurality of road section weighting factors corresponding to the plurality of road sections; calculating the product of the weighting factor for each of the plurality of road sections and the reliability of the real-time traffic condition for a corresponding road section within the traffic data release period; accumulating the products of the road sections with a same type of traffic conditions to obtain a accumulated value for each type of traffic conditions; and determining a traffic condition with the highest accumulated value as the real-time traffic condition for the second target road section within the traffic data release period.

In the case that the traffic data release period includes a plurality of time periods, each of which has a same duration as the first preset period, after comparing the membership degrees of all types of traffic conditions contained in the first fuzzy rule matrix table to determine a real-time traffic condition for the first target road section within the first preset period, the method further includes: reading a priority for each type of traffic conditions; and determining a traffic condition with a high priority among the real-time traffic conditions for the first target road section within each of the time periods as the real-time traffic condition for the first target road section within the traffic data release period.

The determining a membership degree for each type of traffic conditions contained in the first fuzzy rule matrix table by calling a membership function includes: determining the membership degrees for the traffic parameters in the fuzzy rule matrix table by calling the membership function; and determining the membership degree of each type of traffic conditions contained in the fuzzy rule matrix based on the membership degrees of the traffic parameters in the fuzzy rule matrix table.

An apparatus for processing traffic road information includes: a first obtaining unit, configured for obtaining traffic parameters of a first target road section and/or the reliability of the traffic parameters within a first preset period acquired by traffic detection devices, wherein the traffic parameters at least include any one or more of the parameters: a vehicle time occupancy rate, flow saturation of vehicle flow, and a vehicle speed; a matching unit, configured for selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table; a determining unit, configured for determining a membership degree for each type of traffic conditions contained in the first fuzzy rule matrix table by calling a membership function, wherein the traffic conditions at least include the following types: Unblocked, Slow and Congested; and a comparing unit, configured for comparing the membership degrees of all types of traffic conditions contained in the first fuzzy rule matrix table to determine a real-time traffic condition for the first target road section within the first preset period.

In the case that there are at least two traffic parameters of the first target road section, the reliability of the traffic parameters of the first target road section is a combination of the reliability of each of the parameters, the matching unit includes: an obtaining module, configured for obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters; and a matching module, configured for selecting a fuzzy rule matrix table that matches with the reliability of the traffic parameters of the first target road section from the group of fuzzy rule matrix tables to obtain the first fuzzy rule matrix table.

The apparatus further includes: an acquiring unit, configured for acquiring traffic data of the first target road section by using a plurality of traffic detection devices within the first preset period, wherein the plurality of traffic devices at least include a combination of any of the following devices: a magnetic frequency vehicle detector, a wave frequency vehicle detector, a video vehicle detector, a coil vehicle detector, a microwave vehicle detector, a geomagnetic vehicle detector and a SCATS vehicle detector; a processing unit, configured for preprocessing the traffic data to obtain traffic parameters of the first target road section, wherein the preprocessing includes at least one or more of the following processings: filtering of the traffic data, time-space conversion of the traffic data, and data conversion of the traffic data.

The processing unit includes: a first processing module, configured for filtering the traffic data of the first target road section acquired by each of the traffic detection devices respectively according to preset filter conditions to obtain the filtered traffic data acquired by each of the traffic detection devices, wherein the filter conditions at least include one or more of the following conditions: device parameters of the traffic detection devices, vehicle speed limits for different traffic conditions, vehicle flow limits for different types of roads, the vehicle time occupancy rate, correlations between different types of traffic parameters; and a second processing module, configured for performing the time-space conversion and/or data conversion on the filtered traffic data acquired by each of the traffic detection devices to obtain the traffic parameters of the first target road section.

The traffic data at least include one or more types of the following parameters: a vehicle time occupancy rate, flow saturation of vehicle flow, and a vehicle speed, the second processing module includes: a first processing sub-module, configured for calculating the reliability of each type of parameters detected by each of the traffic detection devices within the first preset period based on detection accuracy of each of the traffic detection devices and the data amount of each type of the parameters actually acquired within the first preset period; a second processing sub-module, configured for calculating weighted average of each type of the parameters actually acquired by using the reliability of each type of parameters as weighting factors to obtain the traffic parameters of the first target road section within the first preset period; and a third processing sub-module, configured for obtaining the reliability of the traffic parameters by averaging the reliability of a same type of parameters detected by each of the traffic detection devices.

In the case that a traffic data release period includes a plurality of time periods, each of which has a same duration as the first preset period, the apparatus further includes: a second obtaining unit, configured for obtaining the reliability of real-time traffic conditions for the first target road section within each of the time periods of the traffic data release period; a first accumulation unit, configured for accumulating the reliability of traffic conditions of a same type within each of the time periods to obtain a accumulated reliability value for each type of traffic conditions; a first selecting unit, configured for determining a traffic condition with the highest accumulated reliability value as the real-time traffic condition for the first target road section within the traffic data release period.

The second obtaining unit includes: a first calculation module, configured for calculating, for each of the time periods, a proportion of time in which the traffic on the first target road section is in a passing state; a second calculation module, configured for calculating the reliability of the real-time traffic conditions for the first target section within each of the time periods based on the proportion of time in which the traffic is in the passing state and the reliability of the acquired traffic parameters of the first target road section within each of the time periods.

In the case that a second target road section includes a plurality of spatially discontinuous road sections including the first target road section, the apparatus further includes: a third obtaining unit, configured for reading a plurality of road section weighting factors corresponding to the plurality of road sections; a calculation unit, configured for calculating the product of the weighting factor for each of the plurality of road sections and the reliability of the real-time traffic condition for a corresponding road section within the traffic data release period; a second accumulation unit, configured for accumulating the products of the road sections with a same type of traffic conditions to obtain a accumulated value for each type of traffic conditions; and a second selecting unit, configured for determining a traffic condition with the highest accumulated value as the real-time traffic condition for the second target road section within the traffic data release period.

In the case that the traffic data release period includes a plurality of time periods, each of which has a same duration as the first preset period, the apparatus further includes: a fourth obtaining unit, configured for reading a priority for each type of traffic conditions; and a third selecting unit, configured for determining a traffic condition with a high priority among the real-time traffic conditions for the first target road section within each of the time periods as the real-time traffic condition for the first target road section within the traffic data release period.

The determining unit includes: a first determining module, configured for determining the membership degrees for the traffic parameters in the fuzzy rule matrix table by calling the membership function; and a second determining module, configured for determining the membership degree of each type of traffic conditions contained in the fuzzy rule matrix based on the membership degrees of the traffic parameters in the fuzzy rule matrix table.

A terminal includes:

a processor, a memory, communication interfaces and a bus;

the processor, the memory and the communication interfaces are connected and communicate with each other via the bus;

the memory is configured to store executable program codes; and the processor is configured to execute programs corresponding to the executable program codes by reading the executable program codes stored in the memory for:

obtaining acquired traffic parameters of a first target road section and/or the reliability of the traffic parameters within a first preset period, wherein the traffic parameters at least include any one or more of the following parameters: a vehicle time occupancy rate, flow saturation of vehicle flow, and a vehicle speed;

selecting a first fuzzy rule matrix table from a pre-stored set of fuzzy rule matrix tables based on the number of the traffic parameters of the first target road section and/or the reliability of the traffic parameters, wherein the fuzzy rule matrix tables include any one of the following types of matrix tables: a one-dimensional fuzzy rule matrix table, a two-dimensional fuzzy rule matrix table, and a three-dimensional fuzzy rule matrix table;

determining a membership degree for each type of traffic conditions contained in the first fuzzy rule matrix table by calling a membership function, wherein the traffic conditions at least include the following types: Unblocked, Slow and Congested; and comparing the membership degrees of all types of traffic conditions contained in the first fuzzy rule matrix table to determine a real-time traffic condition for the first target road section within the first preset period.

An application program is configured for carrying out the method for processing traffic road information as described above.

A storage medium is used for storing application program, which is configured for carrying out the method for processing traffic road information as described above.

The invention claimed is:

1. A method for processing traffic road information, comprising:

obtaining acquired traffic parameters of a first target road section and/or the reliability of the traffic parameters within a first preset period, wherein the traffic parameters at least comprise any one or more of the following parameters: a vehicle time occupancy rate, flow saturation of vehicle flow, and a vehicle speed;

selecting a first fuzzy rule matrix table from a pre-stored set of fuzzy rule matrix tables based on the number of the traffic parameters of the first target road section and/or the reliability of the traffic parameters, wherein the fuzzy rule matrix tables comprise any one of the following types of matrix tables: a one-dimensional fuzzy rule matrix table, a two-dimensional fuzzy rule matrix table, and a three-dimensional fuzzy rule matrix table;

determining a membership degree for each type of traffic conditions contained in the first fuzzy rule matrix table by calling a membership function, wherein the traffic conditions at least comprise the following types: Unblocked, Slow and Congested; and comparing the membership degrees of all types of traffic conditions contained in the first fuzzy rule matrix table to determine a real-time traffic condition for the first target road section within the first preset period.

2. The method of claim 1, wherein in the case that there are at least two traffic parameters of the first target road section, the reliability of the traffic parameters of the first target road section is a combination of the reliability of each of the parameters, wherein selecting a first fuzzy rule matrix table from a pre-stored set of fuzzy rule matrix tables based on the number of the traffic parameters of the first target road section and/or the reliability of the traffic parameters comprises:

obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters; and selecting a fuzzy rule matrix table that matches with the reliability of the traffic parameters of the first target road section from the group of fuzzy rule matrix tables to obtain the first fuzzy rule matrix table.

3. The method of claim 1, wherein before obtaining acquired traffic parameters of a first target road section and/or the reliability of the traffic parameters within a first preset period, the method further comprises:

acquiring traffic data of the first target road section by using a plurality of traffic detection devices within the first preset period, wherein the plurality of traffic devices at least comprise a combination of any of the following devices: a magnetic frequency vehicle detector, a wave frequency vehicle detector, a video vehicle detector, a coil vehicle detector, a microwave vehicle detector, a geomagnetic vehicle detector and a SCATS vehicle detector;

preprocessing the traffic data to obtain traffic parameters of the first target road section, wherein the preprocessing comprises at least one or more of the following processings: filtering of the traffic data, time-space conversion of the traffic data, and data conversion of the traffic data.

4. The method of claim 3, wherein preprocessing the traffic data to obtain traffic parameters of the first target road section comprises:

filtering the traffic data of the first target road section acquired by each of the traffic detection devices respectively according to preset filter conditions to obtain the filtered traffic data acquired by each of the traffic detection devices, wherein the filter conditions at least comprise one or more of the following conditions: device parameters of the traffic detection devices, vehicle speed limits for different traffic conditions, vehicle flow limits for different types of roads, the vehicle time occupancy rate, correlations between different types of traffic parameters;

performing the time-space conversion and/or data conversion on the filtered traffic data acquired by each of the traffic detection devices to obtain the traffic parameters of the first target road section.

5. The method of claim 4, wherein the traffic data at least comprise one or more types of the following parameters: a vehicle time occupancy rate, flow saturation of vehicle flow, and a vehicle speed, wherein performing the data conversion on the filtered traffic data acquired by each of the traffic detection devices to obtain the traffic parameters of the first target road section comprises:

calculating the reliability of each type of parameters detected by each of the traffic detection devices within the first preset period based on detection accuracy of each of the traffic detection devices and the data amount of each type of the parameters actually acquired within the first preset period; and calculating weighted average of each type of the parameters actually acquired by using the reliability of each type of parameters as weighting factors to obtain the traffic parameters of the first target road section within the first preset period;

wherein the reliability of the traffic parameters is obtained by averaging the reliability of a same type of parameters detected by each of the traffic detection devices.

6. The method of claim 1, wherein in the case that a traffic data release period comprises a plurality of time periods, each of which has a same duration as the first preset period, after comparing the membership degrees of all types of traffic conditions contained in the first fuzzy rule matrix table to determine a real-time traffic condition for the first target road section within the first preset period, the method further comprises:

obtaining the reliability of real-time traffic conditions for the first target road section within each of the time periods of the traffic data release period;

accumulating the reliability of traffic conditions of a same type within each of the time periods to obtain a accumulated reliability value for each type of traffic conditions;

determining a traffic condition with the highest accumulated reliability value as the real-time traffic condition for the first target road section within the traffic data release period.

7. The method of claim 6, wherein obtaining the reliability of real-time traffic conditions for the first target road section within each of the time periods of the traffic data release period comprises:

calculating, for each of the time periods, a proportion of time in which the traffic on the first target road section is in a passing state;

calculating the reliability of the real-time traffic conditions for the first target section within each of the time periods based on the proportion of time in which the traffic is in the passing state and the reliability of the acquired traffic parameters of the first target road section within each of the time periods.

8. The method of claim 6, wherein in the case that a second target road section comprises a plurality of spatially discontinuous road sections comprising the first target road section, wherein after determining a traffic condition with the highest accumulated reliability value as the real-time traffic condition for the first target road section within the traffic data release period, the method further comprises:

reading a plurality of road section weighting factors corresponding to the plurality of road sections;

calculating the product of the weighting factor for each of the plurality of road sections and the reliability of the real-time traffic condition for a corresponding road section within the traffic data release period;

accumulating the products of the road sections with a same type of traffic conditions to obtain a accumulated value for each type of traffic conditions; and determining a traffic condition with the highest accumulated value as the real-time traffic condition for the second target road section within the traffic data release period.

9. The method of claim 1, wherein in the case that the traffic data release period comprises a plurality of time periods, each of which has a same duration as the first preset period, after comparing the membership degrees of all types of traffic conditions contained in the first fuzzy rule matrix table to determine a real-time traffic condition for the first target road section within the first preset period, the method further comprises:

reading a priority for each type of traffic conditions; and determining a traffic condition with a high priority among the real-time traffic conditions for the first target road section within each of the time periods as the real-time traffic condition for the first target road section within the traffic data release period.

10. The method of claim 1, wherein determining a membership degree for each type of traffic conditions contained in the first fuzzy rule matrix table by calling a membership function comprises:

determining the membership degrees for the traffic parameters in the fuzzy rule matrix table by calling the membership function; and determining the membership degree of each type of traffic conditions contained in the fuzzy rule matrix based on the membership degrees of the traffic parameters in the fuzzy rule matrix table.

11. An apparatus for processing traffic road information, comprising:

a first obtaining unit, configured for obtaining traffic parameters of a first target road section and/or the reliability of the traffic parameters within a first preset period acquired by traffic detection devices, wherein the traffic parameters at least comprise any one or more of the parameters: a vehicle time occupancy rate, flow saturation of vehicle flow, and a vehicle speed;

a matching unit, configured for selecting a first fuzzy rule matrix table from a pre-stored set of fuzzy rule matrix tables based on the number of the traffic parameters of the first target road section and/or the reliability of the traffic parameters, wherein the fuzzy rule matrix tables comprise any one of the following types of matrix tables: a one-dimensional fuzzy rule matrix table, a two-dimensional fuzzy rule matrix table, and a three-dimensional fuzzy rule matrix table;

a determining unit, configured for determining a membership degree for each type of traffic conditions contained in the first fuzzy rule matrix table by calling a membership function, wherein the traffic conditions at least comprise the following types: Unblocked, Slow and Congested; and a comparing unit, configured for comparing the membership degrees of all types of traffic conditions contained in the first fuzzy rule matrix table to determine a real-time traffic condition for the first target road section within the first preset period.

12. The apparatus of claim 11, wherein in the case that there are at least two traffic parameters of the first target road section, the reliability of the traffic parameters of the first target road section is a combination of the reliability of each of the parameters, the matching unit comprises:

an obtaining module, configured for obtaining a group of fuzzy rule matrix tables from the pre-stored set of fuzzy rule matrix tables based on the number of the traffic parameters of the first target road section, wherein the dimension of each fuzzy rule matrix table contained in the group of fuzzy rule matrix tables is the same as the number of the parameters; and a matching module, configured for selecting a fuzzy rule matrix table that matches with the reliability of the traffic parameters of the first target road section from the group of fuzzy rule matrix tables to obtain the first fuzzy rule matrix table.

13. The apparatus according to claim 11, wherein the apparatus further comprises:

an acquiring unit, configured for acquiring traffic data of the first target road section by using a plurality of traffic detection devices within the first preset period, wherein the plurality of traffic devices at least comprise a combination of any of the following devices: a magnetic frequency vehicle detector, a wave frequency vehicle detector, a video vehicle detector, a coil vehicle detector, a microwave vehicle detector, a geomagnetic vehicle detector and a SCATS vehicle detector;

a processing unit, configured for preprocessing the traffic data to obtain traffic parameters of the first target road section, wherein the preprocessing comprises at least one or more of the following processings: filtering of the traffic data, time-space conversion of the traffic data, and data conversion of the traffic data.

14. The apparatus of claim 13, wherein the processing unit comprises:

a first processing module, configured for filtering the traffic data of the first target road section acquired by each of the traffic detection devices respectively according to preset filter conditions to obtain the filtered traffic data acquired by each of the traffic detection devices, wherein the filter conditions at least comprise one or more of the following conditions: device parameters of the traffic detection devices, vehicle speed limits for different traffic conditions, vehicle flow limits for different types of roads, the vehicle time occupancy rate, correlations between different types of traffic parameters; and a second processing module, configured for performing the time-space conversion and/or data conversion on the filtered traffic data acquired by each of the traffic detection devices to obtain the traffic parameters of the first target road section.

15. The apparatus of claim 14, wherein the traffic data at least comprise one or more types of the following parameters: a vehicle time occupancy rate, flow saturation of vehicle flow, and a vehicle speed, the second processing module comprises:

a first processing sub-module, configured for calculating the reliability of each type of parameters detected by each of the traffic detection devices within the first preset period based on detection accuracy of each of the traffic detection devices and the data amount of each type of the parameters actually acquired within the first preset period;

a second processing sub-module, configured for calculating weighted average of each type of the parameters actually acquired by using the reliability of each type of parameters as weighting factors to obtain the traffic parameters of the first target road section within the first preset period; and a third processing sub-module, configured for obtaining the reliability of the traffic parameters by averaging the reliability of a same type of parameters detected by each of the traffic detection devices.

16. The apparatus of claim 11, wherein in the case that a traffic data release period comprises a plurality of time periods, each of which has a same duration as the first preset period, the apparatus further comprises:

a second obtaining unit, configured for obtaining the reliability of real-time traffic conditions for the first target road section within each of the time periods of the traffic data release period;

a first accumulation unit, configured for accumulating the reliability of traffic conditions of a same type within each of the time periods to obtain a accumulated reliability value for each type of traffic conditions;

a first selecting unit, configured for determining a traffic condition with the highest accumulated reliability value as the real-time traffic condition for the first target road section within the traffic data release period.

17. The apparatus of claim 16, wherein the second obtaining unit comprises:

a first calculation module, configured for calculating, for each of the time periods, a proportion of time in which the traffic on the first target road section is in a passing state;

a second calculation module, configured for calculating the reliability of the real-time traffic conditions for the first target section within each of the time periods based on the proportion of time in which the traffic is in the passing state and the reliability of the acquired traffic parameters of the first target road section within each of the time periods.

18. The apparatus of claim 16, wherein in the case that a second target road section comprises a plurality of spatially discontinuous road sections comprising the first target road section, the apparatus further comprises:

a third obtaining unit, configured for reading a plurality of road section weighting factors corresponding to the plurality of road sections;

a calculation unit, configured for calculating the product of the weighting factor for each of the plurality of road sections and the reliability of the real-time traffic condition for a corresponding road section within the traffic data release period;

a second accumulation unit, configured for accumulating the products of the road sections with a same type of traffic conditions to obtain a accumulated value for each type of traffic conditions; and a second selecting unit, configured for determining a traffic condition with the highest accumulated value as the real-time traffic condition for the second target road section within the traffic data release period.

19. A terminal, comprising:

a processor, a memory, communication interfaces and a bus;

the processor, the memory and the communication interfaces are connected and communicate with each other via the bus;

the memory is configured to store executable program codes; and the processor is configured to execute programs corresponding to the executable program codes by reading the executable program codes stored in the memory for:

obtaining acquired traffic parameters of a first target road section and/or the reliability of the traffic parameters within a first preset period, wherein the traffic parameters at least comprise any one or more of the following parameters: a vehicle time occupancy rate, flow saturation of vehicle flow, and a vehicle speed;

selecting a first fuzzy rule matrix table from a pre-stored set of fuzzy rule matrix tables based on the number of the traffic parameters of the first target road section and/or the reliability of the traffic parameters, wherein the fuzzy rule matrix tables comprise any one of the following types of matrix tables: a one-dimensional fuzzy rule matrix table, a two-dimensional fuzzy rule matrix table, and a three-dimensional fuzzy rule matrix table;

determining a membership degree for each type of traffic conditions contained in the first fuzzy rule matrix table by calling a membership function, wherein the traffic conditions at least comprise the following types: Unblocked, Slow and Congested; and comparing the membership degrees of all types of traffic conditions contained in the first fuzzy rule matrix table to determine a real-time traffic condition for the first target road section within the first preset period.

20. A storage medium, which is used for storing application program configured for carrying out the method for processing traffic road information of claim 1.

* * * * *